US009330594B2

(12) United States Patent
Tada et al.

(10) Patent No.: US 9,330,594 B2
(45) Date of Patent: May 3, 2016

(54) POWER CONSUMPTION CONTROLLER, IMAGE PROCESSOR, SELF-LUMINOUS DISPLAY APPARATUS, ELELCRTONIC EQUIPMENT, POWER CONSUMPTION CONTROL METHOD AND COMPUTER PROGRAM

(75) Inventors: Mitsuru Tada, Kanagawa (JP); Atsushi Ozawa, Kanagawa (JP)

(73) Assignee: JOLED Inc., Tokyo (JP)

( * ) Notice: Subject to any disclaimer, the term of this patent is extended or adjusted under 35 U.S.C. 154(b) by 1294 days.

(21) Appl. No.: 11/992,092

(22) PCT Filed: Jul. 25, 2007

(86) PCT No.: PCT/JP2007/064585

§ 371 (c)(1),
(2), (4) Date: Mar. 14, 2008

(87) PCT Pub. No.: WO2008/013201

PCT Pub. Date: Jan. 31, 2008

(65) Prior Publication Data

US 2009/0153537 A1 Jun. 18, 2009

(30) Foreign Application Priority Data

Jul. 25, 2006 (JP) ..... 2006-201548

(51) Int. Cl.
*G09G 5/00* (2006.01)
*G09G 3/30* (2006.01)
*G09G 3/32* (2016.01)

(52) U.S. Cl.
CPC ..... *G09G 3/30* (2013.01); *G09G 3/3233* (2013.01); *G09G 3/3291* (2013.01);

(Continued)

(58) Field of Classification Search
USPC ..... 345/55, 78, 82, 76, 211–212, 102, 590; 713/300
See application file for complete search history.

(56) References Cited

U.S. PATENT DOCUMENTS 6,204,610 B1 * 3/2001 Komiya ..... 315/169.3
7,389,432 B2 * 6/2008 Chandley et al. ..... 713/320

(Continued)

FOREIGN PATENT DOCUMENTS

EP 1 583 067 A1 10/2005
GB 2389952 * 12/2003

(Continued)

OTHER PUBLICATIONS

Extended European Search Report issued on Aug. 30, 2010 for corresponding European Application No. 07 79 1301.

(Continued)

*Primary Examiner* — Calvin C Ma
(74) *Attorney, Agent, or Firm* — Michael Best & Friedrich LLP

(57) ABSTRACT

The prior art power consumption control techniques convert the video signal (gray level) in one way or another based on the estimated power consumption level. The present invention proposes a power consumption controller which includes (a) a power consumption calculation section which sequentially calculates the power consumption level of a self-luminous display device based on a video signal input from the beginning of each frame up to the time of calculation, (b) a power consumption status determination section which determines whether the calculated power consumption level exceeds a reference value for comparison by constantly comparing the two levels. If this is the case, the same section detects the timing at which the power consumption exceeds the reference value for comparison and (c) a peak brightness control section which controls the peak brightness of the self-luminous display device if the power consumption level exceeds the reference value for comparison based on the detected timing.

18 Claims, 38 Drawing Sheets

(52) U.S. Cl.
CPC ..... *G09G 2300/0861* (2013.01); *G09G 2300/0866* (2013.01); *G09G 2320/0626* (2013.01); *G09G 2330/021* (2013.01); *G09G 2330/028* (2013.01); *G09G 2330/045* (2013.01); *G09G 2360/16* (2013.01)

(56) References Cited

U.S. PATENT DOCUMENTS

| | | | | |
|---|---|---|---|---|
| 7,764,252 | B2 * | 7/2010 | Miller et al. | 345/77 |
| 2003/0218583 | A1 | 11/2003 | Hasagawa | |
| 2005/0237002 | A1 * | 10/2005 | Nakamura | 315/169.3 |
| 2005/0264492 | A1 * | 12/2005 | Knapp et al. | 345/76 |
| 2006/0066533 | A1 | 3/2006 | Sato et al. | |
| 2006/0105198 | A1 * | 5/2006 | Spindler et al. | 428/690 |
| 2006/0262111 | A1 * | 11/2006 | Kerofsky | 345/211 |
| 2007/0080905 | A1 * | 4/2007 | Takahara | 345/76 |
| 2007/0146252 | A1 * | 6/2007 | Miller et al. | 345/77 |
| 2008/0100542 | A1 * | 5/2008 | Miller et al. | 345/77 |

FOREIGN PATENT DOCUMENTS

| | | | | |
|---|---|---|---|---|
| JP | HEI-04-338998 | | 11/1992 | |
| JP | HEI-08-044314 | | 2/1996 | |
| JP | 2000-267628 | | 9/2000 | |
| JP | 2000-267628 | A | 9/2000 | |
| JP | WO2004/100118 | * | 11/2004 | G09G 3/30 |
| JP | 2004-354762 | | 12/2004 | |
| JP | 2005-070426 | | 3/2005 | |
| JP | 2005-301095 | | 10/2005 | |
| JP | 2006-091681 | A | 4/2006 | |
| JP | 2006-113212 | | 4/2006 | |
| JP | 2006-119465 | | 5/2006 | |
| WO | WO-2004/064030 | A1 | 7/2004 | |

OTHER PUBLICATIONS

English language translation of a Japanese Office Action issued Nov. 27, 2012 for corresponding Japanese Application No. 2006-201548.

* cited by examiner

VS

VIDEO SIGNAL

POWER CONSUMPTION OF INPUT VIDEO SIGNAL
ALLOWABLE LIMIT
ALLOWABLE LIMIT / 2
0

POWER CONSUMPTION OF INPUT VIDEO SIGNAL
ALLOWABLE LIMIT
ALLOWABLE LIMIT / 2
0
Δ
OVER-LIMIT TIMING 1
OVER-LIMIT TIMING 2

VERTICAL SYNCHRONIZING PULSE

DUTY PULSE

VS

VIDEO SIGNAL

POWER CONSUMPTION
OF INPUT VIDEO SIGNAL
ALLOWABLE LIMIT
0
OVER-LIMIT TIMING

DUTY PULSE
H
L
SET PULSE LENGTH

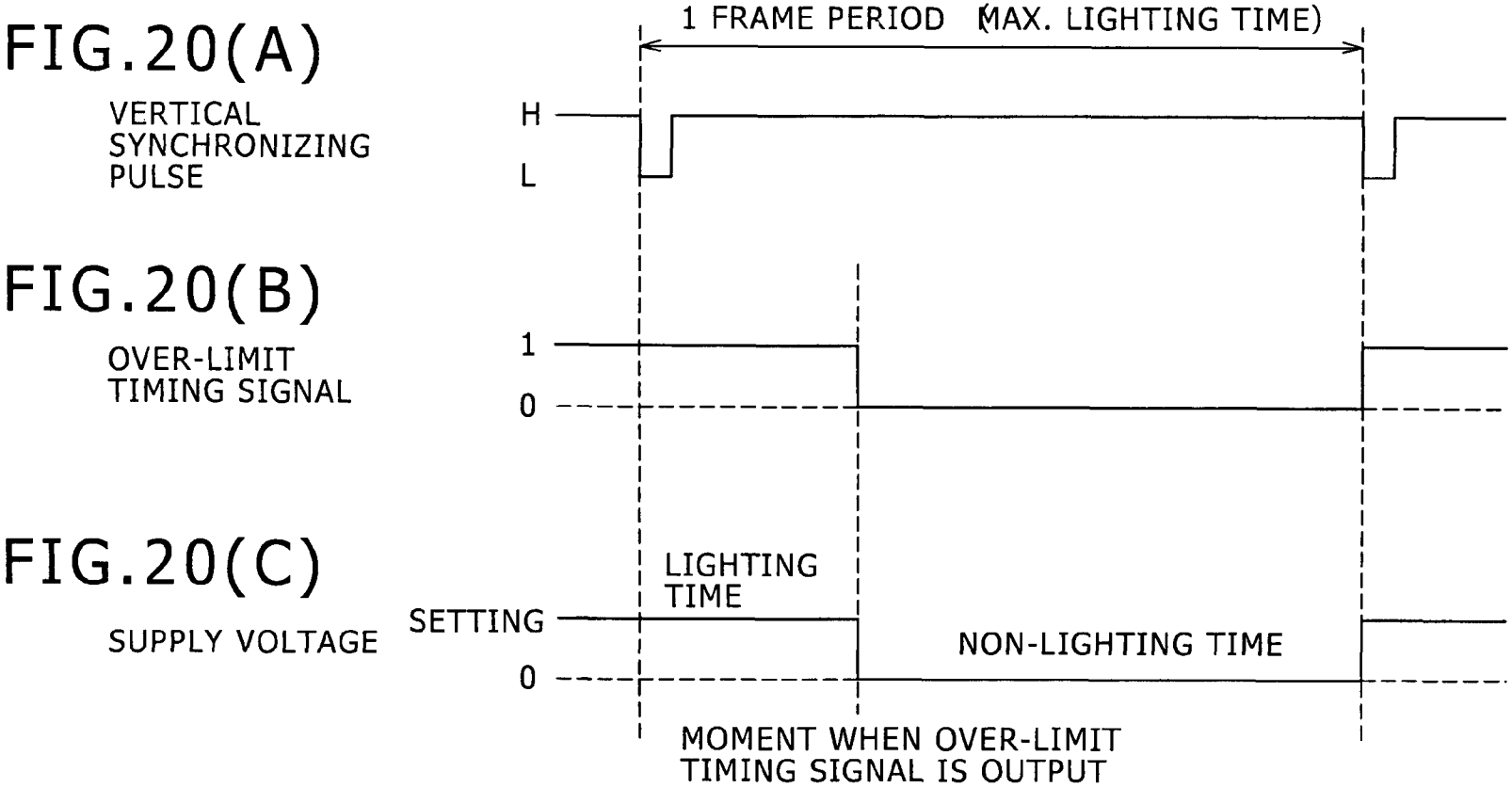
FIG.20(A) VERTICAL SYNCHRONIZING PULSE
FIG.20(B) OVER-LIMIT TIMING SIGNAL
FIG.20(C) SUPPLY VOLTAGE

VS

VIDEO SIGNAL

POWER CONSUMPTION
OF INPUT VIDEO SIGNAL
ALLOWABLE LIMIT
0
OVER-LIMIT TIMING

SETTING
0
LIT
UNLIT

VERTICAL SYNCRONIZING PULSE

OVER-LIMIT TIMING SIGNAL 1

OVER-LIMIT TIMING SIGNAL 2

SUPPLY VOLTAGE
H
L
H
L
H
L
SETTING
0
1 FRAME PERIOD (MAX.LIGHTING TIME)
LIGHTING TIME
VOLTAGE LEVEL DETERMINED BASED ON REMAINING AVAILABLE POWER AND SCAN POSITION

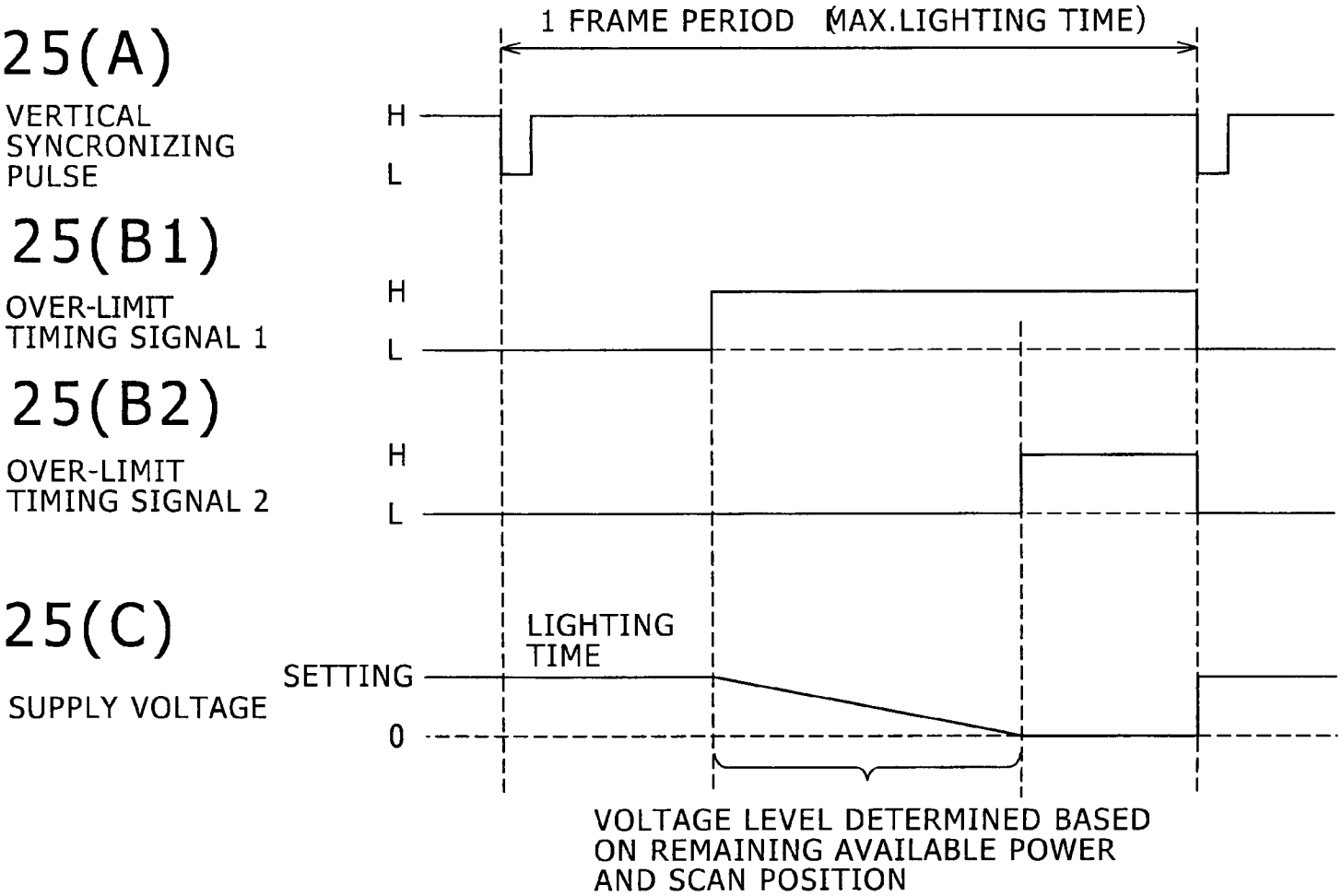
FIG.25(A) VERTICAL SYNCRONIZING PULSE
FIG.25(B1) OVER-LIMIT TIMING SIGNAL 1
FIG.25(B2) OVER-LIMIT TIMING SIGNAL 2
FIG.25(C) SUPPLY VOLTAGE

VS

VIDEO SIGNAL

POWER CONSUMPTION
OF INPUT VIDEO SIGNAL
ALLOWABLE LIMIT
ALLOWABLE LIMIT / 2
0

SETTING
SUPPLY VOLTAGE
0

VS

VIDEO SIGNAL

POWER CONSUMPTION
OF INPUT VIDEO SIGNAL
ALLOWABLE LIMIT
ALLOWABLE LIMIT / 2
0

SETTING
SUPPLY VOLTAGE
0

HORIZONTAL SYNCHRONIZING PULSE

DUTY PULSE

VERTICAL SYNCHRONIZING PULSE

DUTY PULSE

POWER CONSUMPTION CONTROLLER, IMAGE PROCESSOR, SELF-LUMINOUS DISPLAY APPARATUS, ELELCRTONIC EQUIPMENT, POWER CONSUMPTION CONTROL METHOD AND COMPUTER PROGRAM

TECHNICAL FIELD

The invention described in this specification relates to a technique for controlling the power consumption of a self-luminous display apparatus to within an allowable limit.

It should be noted that the invention proposed by the inventors relates to a power consumption controller, an image processor, a self-luminous display apparatus, electronic equipment, a power consumption control method and a computer program.

BACKGROUND ART

A self-luminous display device has the property that the power consumption changes at all times depending on the image displayed. Therefore, the establishment of a technique is required which can control the power consumption of a self-luminous display device to within an allowable range.

Among examples of power consumption control techniques is that descried in Japanese Patent Laid-Open No. 2004-354762.

Japanese Patent Laid-Open No. 2004-354762 discloses an arrangement which estimates the power consumption of the entire screen based on a video signal (gray level) per frame stored in a frame memory and converts the video signal (gray level) stored in the frame memory according to the estimated power consumption.

DISCLOSURE OF THE INVENTION

In the case of the invention described in Japanese Patent Laid-Open No. 2004-354762, however, the video signal (gray level) is converted in one way or another based on the estimated power consumption level. That is, even an image which inherently does not require any conversion (which does not consume power beyond the allowable limit) is subjected to conversion which entails image quality degradation.

For this reason, the inventors propose a power consumption controller which includes (a) a power consumption calculation section, (b) a power consumption status determination section and (c) a peak brightness control section. The power consumption calculation section sequentially calculates the power consumption level of a self-luminous display device based on a video signal input from the beginning of each frame up to the time of calculation. The power consumption status determination section determines whether the calculated power consumption level exceeds a reference value for comparison by constantly comparing the two levels. If this is the case, the same section detects the timing at which the power consumption exceeds the reference value for comparison. The peak brightness control section controls the peak brightness of the self-luminous display device if the power consumption level exceeds the reference value for comparison based on the detected timing.

The control technique proposed by the inventors makes it possible to calculate the power consumption of a self-luminous display device in real time despite using a simple system configuration, thus controlling the power consumption only if the allowable limit is exceeded.

BRIEF DESCRIPTION OF THE DRAWINGS

FIG. 1 is a view illustrating an example of functional configuration of a power consumption controller.

FIG. 2 is a view illustrating an example of functional block configuration of a power consumption calculation section.

FIG. 3 is a view illustrating an example of gray level vs current relationship.

[FIG. 4]

FIG. 5 is a flowchart illustrating the steps until the power consumption is calculated.

FIG. 6 is a flowchart illustrating the steps for controlling the peak brightness condition based on the calculated power consumption.

FIG. 7 is a view illustrating another example of functional configuration of the power consumption controller.

[FIG. 8]

FIG. 9 is a flowchart illustrating the steps for controlling the peak brightness condition based on the calculated power consumption.

FIG. 10 is a view illustrating an example of a display apparatus which controls the duty pulse length using a control technique 1.

FIG. 11 is a view describing the structure of a display pixel.

[FIG. 12]

FIG. 13 is a view illustrating an example of internal configuration of a duty pulse generating section.

[FIG. 14]

[FIG. 15]

FIG. 16 is a view illustrating an example of a display apparatus which controls the supply voltage using the control technique 1.

FIG. 17 is a view describing the structure of a display pixel.

[FIG. 18]

FIG. 19 is a view illustrating an example of internal configuration of a supply voltage control section.

[FIG. 20]

FIGS. 20(A) to 20(C) are views illustrating how the supply voltage is controlled by an over-limit timing signal.

[FIG. 21]

FIG. 22 is a view illustrating an example of a display apparatus which controls the supply voltage using a control technique 2.

FIG. 23 is a view illustrating an example of internal configuration of the supply voltage control section.

[FIG. 24]

FIGS. 24(A) to 24(C) are views illustrating how the supply voltage is controlled by the over-limit timing signal.

[FIG. 25]

FIGS. 25(A) to 25(C) are views illustrating how the supply voltage is controlled by the over-limit timing signal.

[FIG. 26]

[FIG. 27]

FIG. 28 is a view illustrating an example of the power consumption controller incorporated in a self-luminous display apparatus.

FIG. 29 is a view illustrating an example of the power consumption controller incorporated in an image processor.

FIG. 30 is a view illustrating an example of the power consumption controller incorporated in electronic equipment.

FIG. 31 is a view illustrating an example of the power consumption controller incorporated in electronic equipment.

FIG. 32 is a view illustrating an example of the power consumption controller incorporated in electronic equipment.

FIG. 33 is a view illustrating an example of the power consumption controller incorporated in electronic equipment.

FIG. 34 is a view illustrating an example of the power consumption controller incorporated in electronic equipment.

[FIG. 35]

[FIG. 36]

[FIG. 37]

[FIG. 38]

BEST MODE FOR CARRYING OUT THE INVENTION

The power consumption control techniques according to the present invention will be described below.

It should be noted that well-known or publicly known techniques in the pertaining technical field are applied to any item which is not particularly illustrated or described in the present specification.

It should also be noted that the embodiments described herein are merely exemplary and that the invention is not limited to such examples.

(A) Control Technique 1

The first control technique proposed by the inventors will be described below.

(A-1) Configuration of the Self-Luminous Display Panel

Here, we assume that an organic EL display panel is used which has pixels arranged in a matrix form. That is, we assume that the self-luminous display panel used has organic-EL elements provided at intersections between Y electrodes (data lines) and X electrodes (gate lines) on a glass substrate. It should be noted that the organic EL panel is designed to display color image. Therefore, each pixel on the display includes subpixels of RGB.

It should also be noted that linear sequential scanning is used to drive the organic EL display panel. That is, the drive method used controls the lighting of pixels on a horizontal line by horizontal line basis.

In the present embodiment, however, the organic EL panel used incorporates a capacitor in a pixel circuit for each of the organic EL elements.

In this organic EL display panel, therefore, written gray level information (voltage level) is held until a next write timing thanks to the storage capability of the capacitor incorporated. As a result, the organic EL display panel lights up in the same manner as in frame sequential scanning. That is, gray level information (voltage level) is written on a horizontal line by horizontal line basis, and the lighting of each pixel based on the gray level information (voltage level) is maintained for one frame from the moment of writing.

(A-2) Basic Configuration of the Power Consumption Controller

Figure 1:
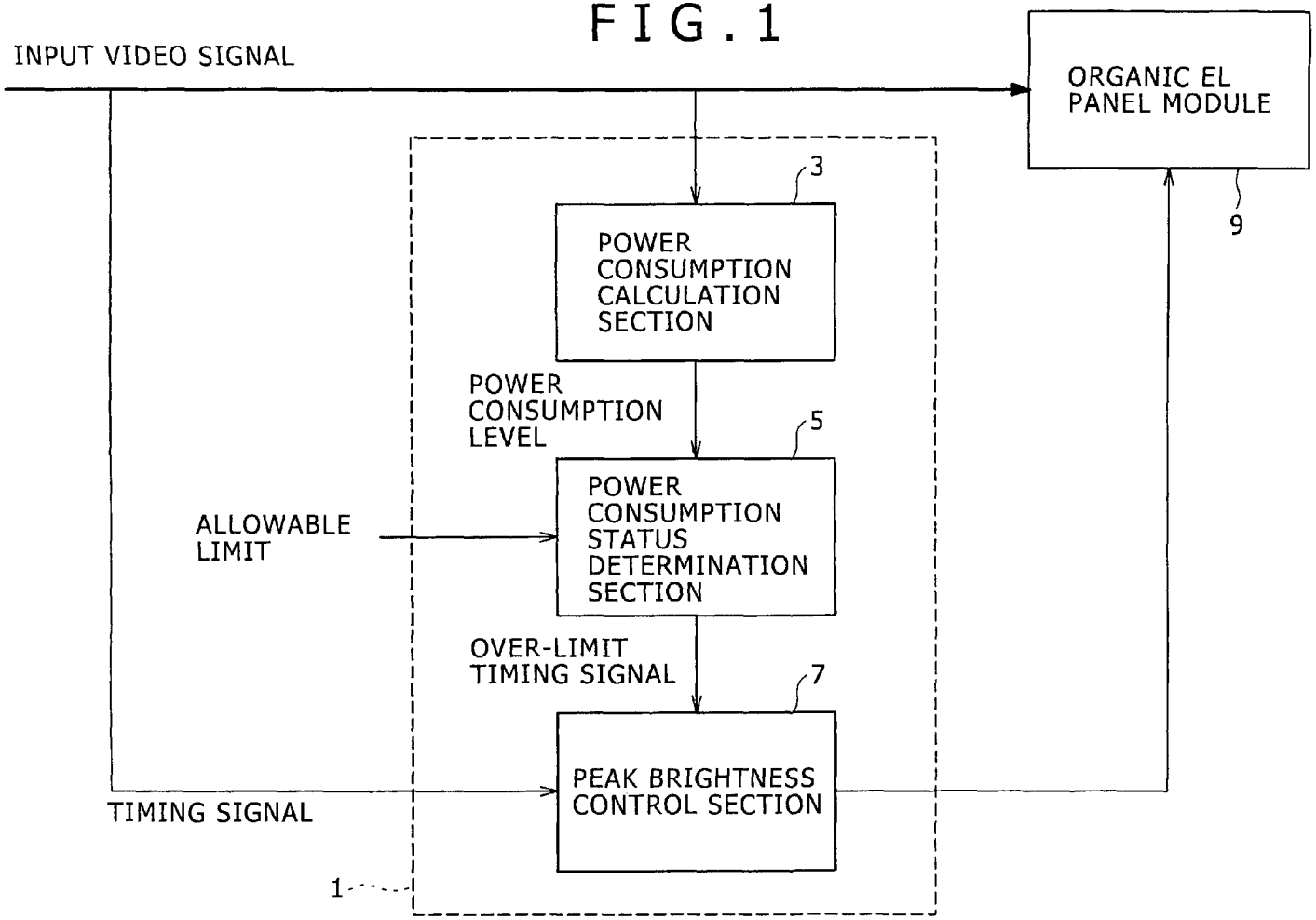
[FIG. 1]

FIG. 1 illustrates the basic configuration of a power consumption controller 1 proposed by the inventors. The same controller 1 includes three functional blocks, namely, a power consumption calculation section 3, a power consumption status determination section 5 and a peak brightness control section 7.

The power consumption calculation section 3 is a processing device operable to sequentially calculate the power consumption level of the self-luminous display device based on a video signal input from the beginning of each frame up to the time of calculation. That is, the same section 3 resets the calculated value when a vertical synchronizing signal is detected. Thereafter, the same section 3 cumulatively updates the power consumption on a pixel by pixel basis or at intervals of one horizontal line period according to the input video signal (nature of the image).

The power consumption status determination section 5 is a processing device operable to determine whether the calculated power consumption level exceeds the allowable limit (reference value for comparison) by constantly comparing the two levels. If this is the case, the same section 5 detects the timing at which the power consumption exceeds the reference value for comparison.

This determination is most accurate when the display screen lights up almost uniformly as a whole. Incidentally, we assume that the display screen lights up almost uniformly as a whole. Then, the larger the power consumed per frame, the earlier the power consumption level per frame exceeds the allowable limit (reference value for comparison) after the beginning of reception of a video signal for the frame. It should be noted that the timing at which the allowable limit is exceeded is determined on a pixel by pixel or horizontal line by horizontal line basis although this timing is affected by the timing at which the power consumption level is updated.

The peak brightness control section 7 is a processing device operable to control the peak brightness of an organic EL panel module 9 if the power consumption level exceeds the allowable limit (reference value for comparison). The same section 7 does so based on the detected timing. To control the peak brightness, the same section 7 changes the length of lighting time per frame (duty pulse length). Alternatively, the same section 7 controls the supply or interruption of supply voltage required to light up and drive the organic EL elements. The control procedures for the two methods will be described later.

(a) Internal Configuration of the Power Consumption Calculation Section 3

Figure 2:
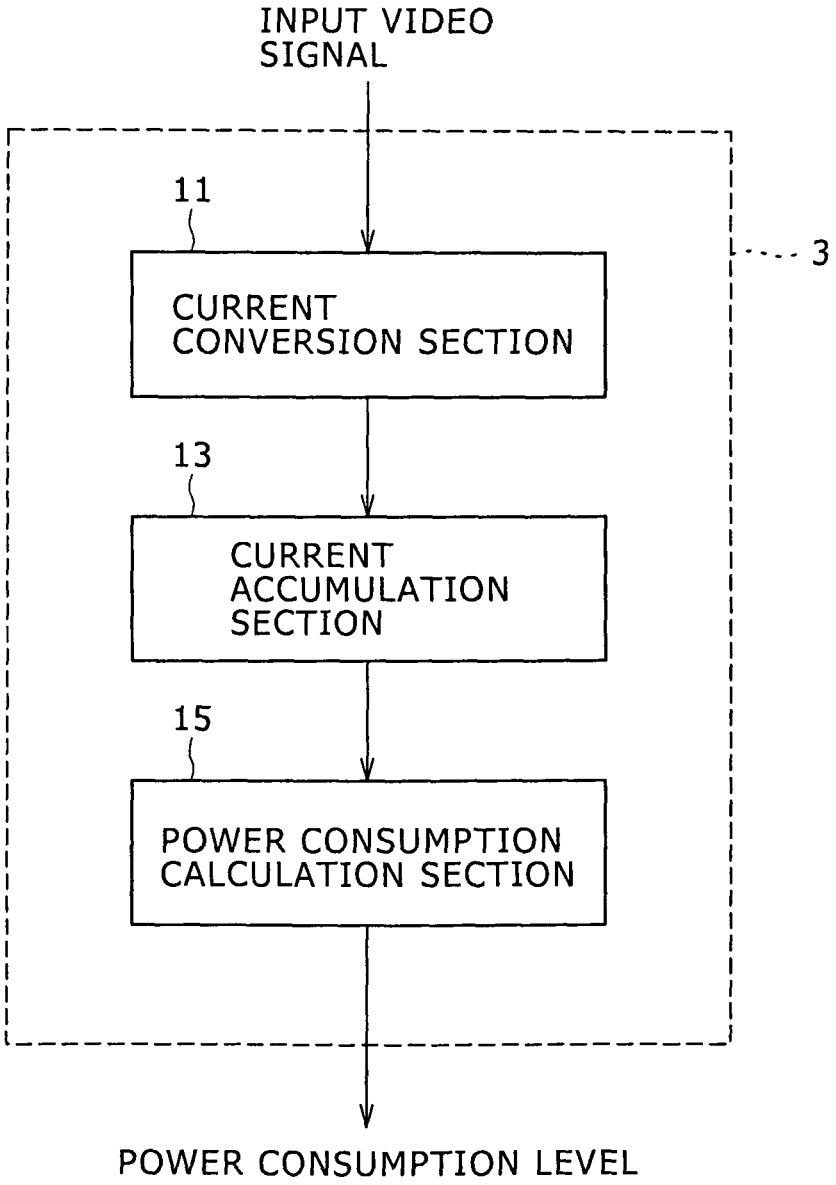
[FIG. 2]

FIG. 2 illustrates the functional block configuration of the power consumption calculation section 3. In the present embodiment, the same section 3 includes three functional blocks, namely, a current conversion section 11, a current accumulation section 13 and a power consumption calculation section 15.

The current conversion section 11 is a processing device operable to convert a video signal for each pixel (gray level) into a current i. In the present embodiment, the same section 11 converts the gray level for each pixel into a current using a conversion table which stores the relationship between the gray level and the current flowing through the organic EL element.

Figure 3:
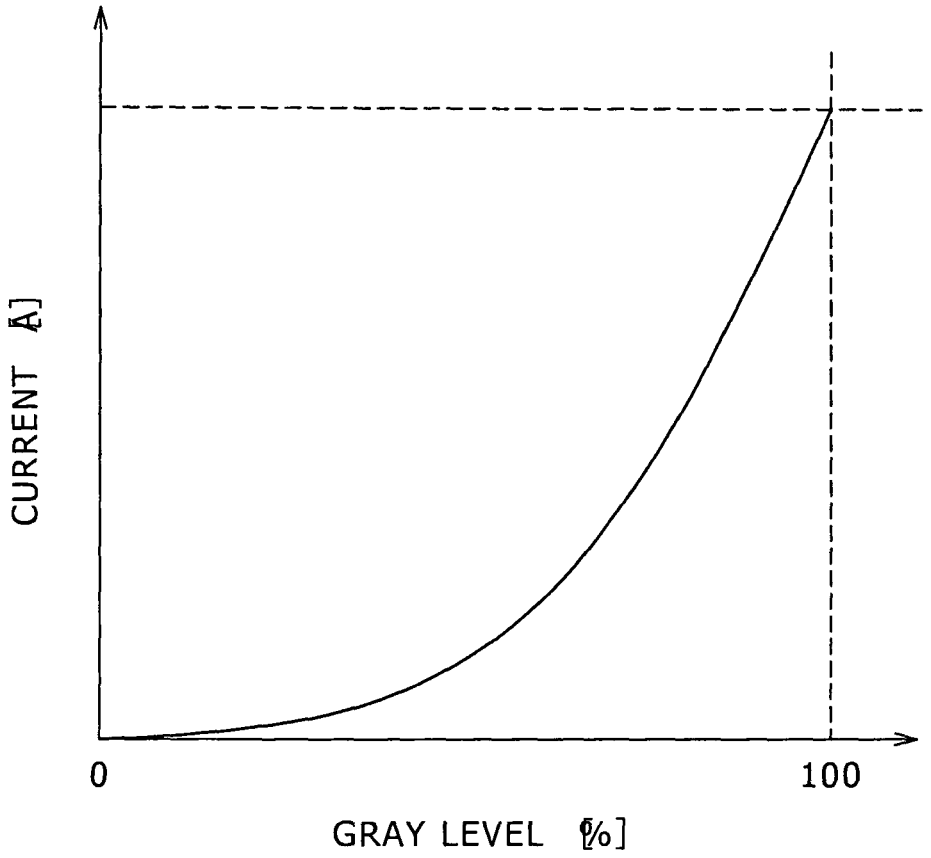
[FIG. 3]

FIG. 3 illustrates an example of relationship between the gray level and the current. As illustrated in FIG. 3, a non-linear relationship is generally observed between the gray level and the current. This relationship can be found by experiment in advance. In the present embodiment, this relationship is stored in the conversion table.

The current accumulation section 13 is a processing device operable to calculate the sum of the current i for a video signal input from the beginning of each frame up to the time of calculation. Basically, the total current is updated on a pixel by pixel basis. However, the total current may also be calculated every horizontal line period by accumulating the current for the horizontal resolution.

The power consumption calculation section 15 is a processing device operable to calculate power W (=IXVcc; Vcc is a supply voltage applied to the organic EL element) consumed by displaying the video signal input from the beginning of each frame up to the time of calculation. To do so, the same section 15 multiplies a total current I (=Σi) by the supply voltage Vcc. In the case of an ordinary display system, the supply voltage Vcc is fixed. However, if the supply voltage Vcc is varied, for example, to control the peak brightness, the supply voltage Vcc at the time of calculation is used.

Figures 4A, 4B, 4C, 4D:
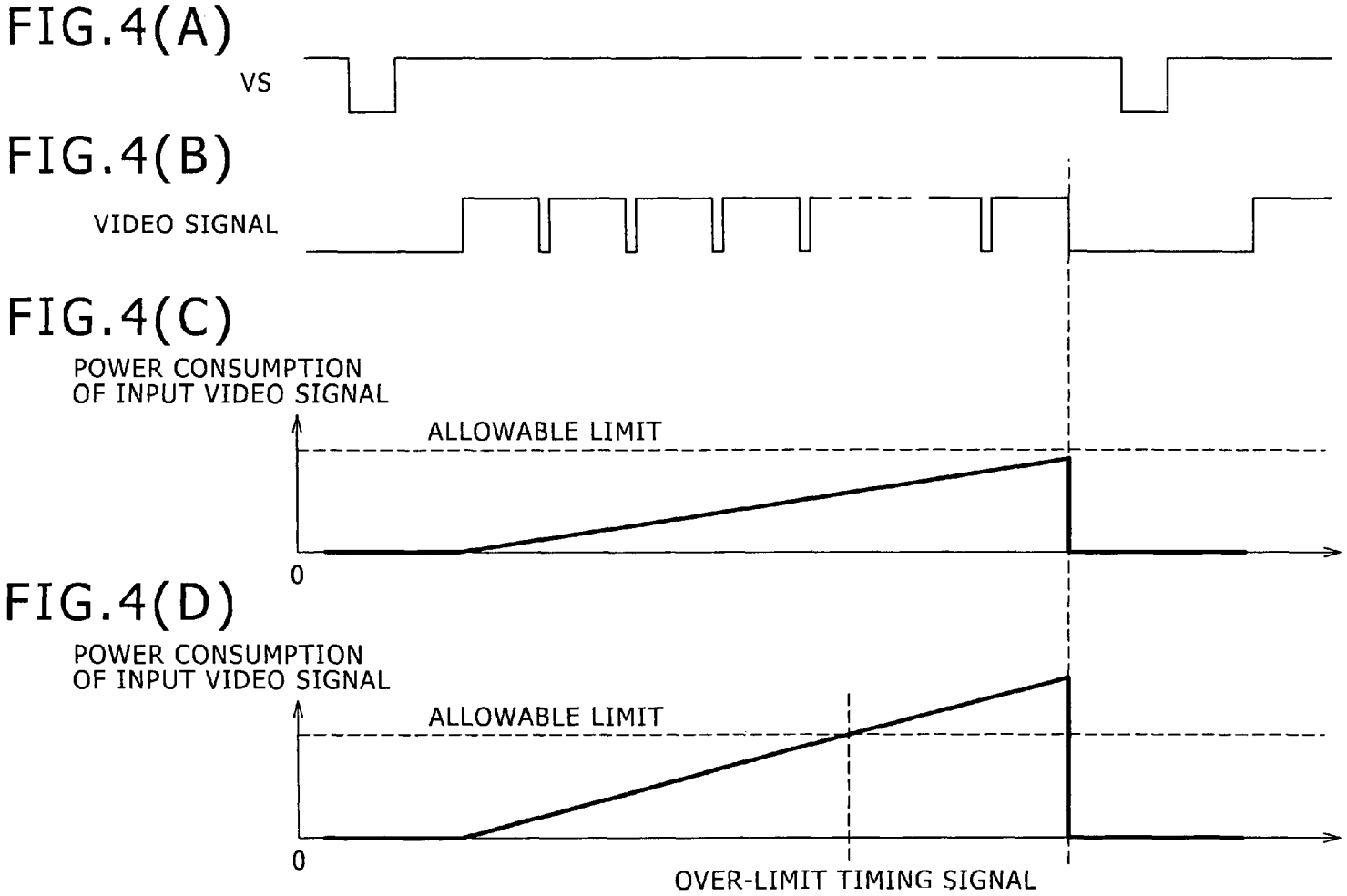
FIGS. 4(A) to 4(D) are views describing the determination carried out by a power consumption status determination section.

(b) Internal Configuration of the Power Consumption Status Determination Section FIGS. 4(A) to 4(D) illustrate the details of the processing performed by the power consumption status determination section 5. Incidentally, FIG. 4(A) illustrates a vertical synchronizing pulse VS adapted to give the start position of a frame. FIG. 4(B) illustrates video signal trains which appear during a frame period. Video signal trains appear in synchronism with a horizontal synchronizing pulse. As many of signal trains as the vertical resolution appear.

FIGS. 4(C) and 4(D) illustrate the change in power consumption resulting from displaying a video signal input during a frame period. However, if the video signal is a moving image, an error may occur between the calculated and actual power consumption levels depending on the nature of the peak brightness control method.

The reason for the above is as follows. The power consumption W calculated by the power consumption calculation section 3 represents only the power consumed by writing the video signal (gray level) to the pixel circuits. Therefore, the power consumption W does not reflect the power consumed by the pixels in which the organic EL element continues to emit light due to the video signal written during the previous frame period.

FIG. 4(C) illustrates the case in which the power consumption calculated based on the video signal making up one frame remains below the allowable limit. In this case, the power consumption status determination section 5 does not output any signal indicating that the allowable limit has been exceeded.

On the other hand, FIG. 4(D) illustrates the case in which the power consumption calculated based on the video signal making up one frame exceeds the allowable limit halfway through the frame period. In this case, the power consumption status determination section 5 outputs an over-limit timing signal indicating that the allowable limit has been exceeded upon exceeding of the limit.

An over-limit timing signal is output on a pixel by pixel or horizontal line by horizontal line basis. Naturally, the timing can be detected with more precision if the signal is output on a pixel by pixel basis. However, the appropriate one of the two choices is selected in consideration of various factors, including the accuracy required of the calculation, the load required for the calculation and effects to be achieved by the peak brightness control.

(A-3) Control Operation and Effects

A description will be made below about the power consumption control performed by the power consumption controller 1 having the above functional configuration in terms of the processing steps.

Figure 5:
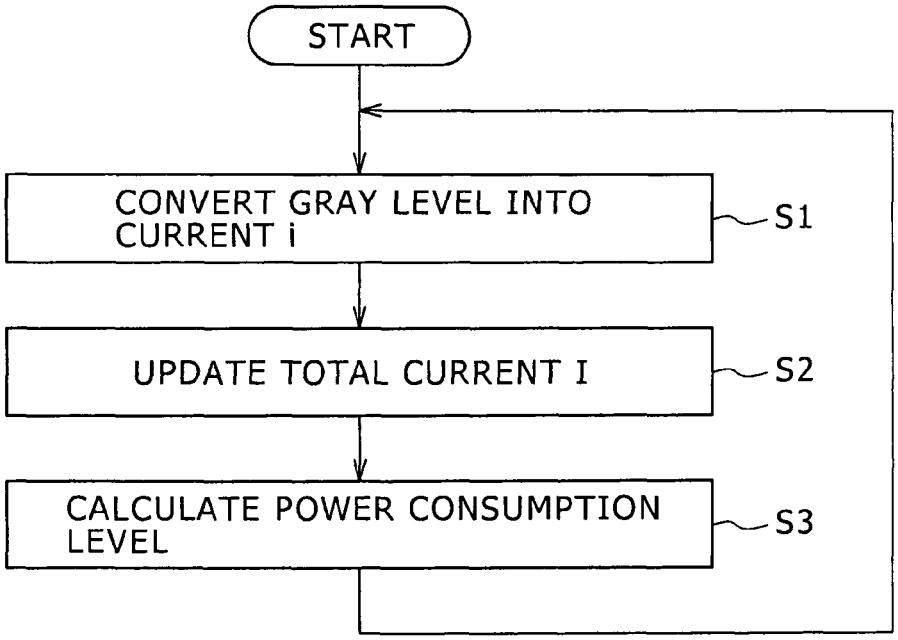
[FIG. 5]
Figure 6:
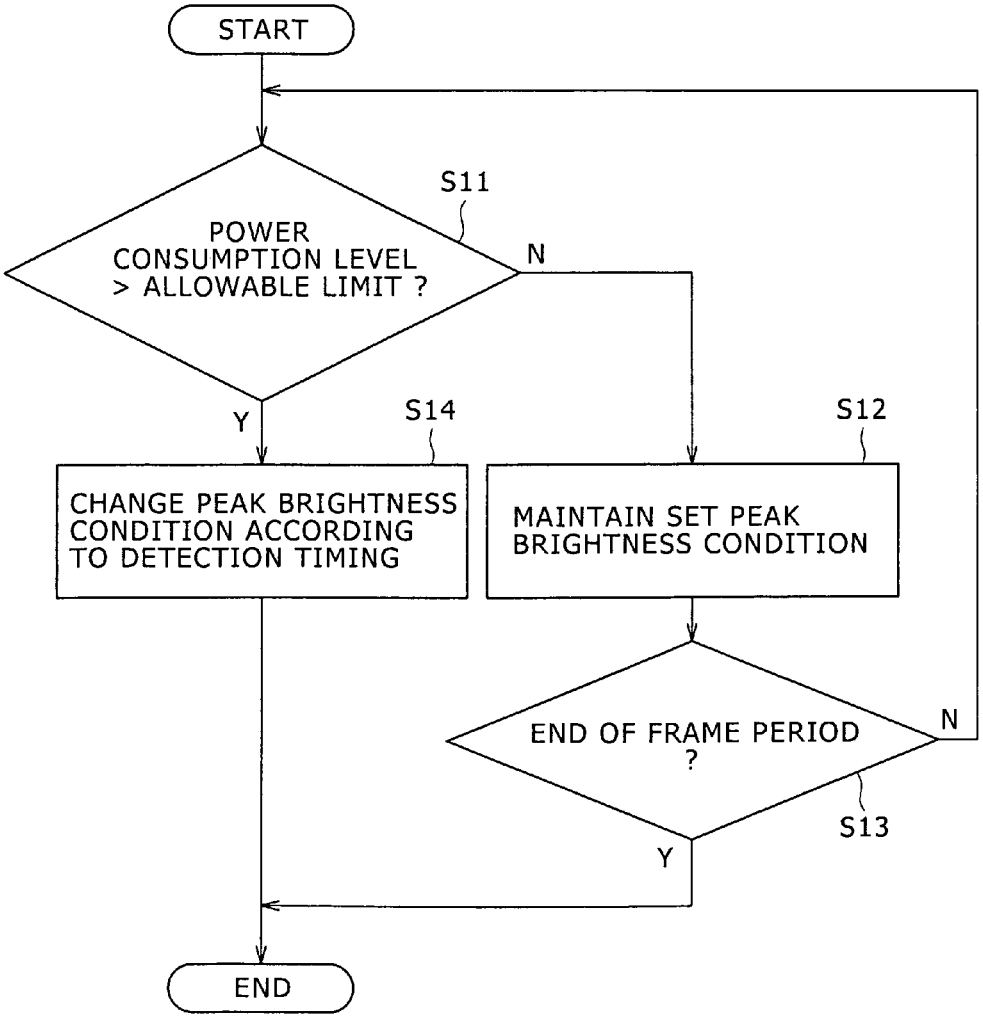
[FIG. 6]

FIG. 5 illustrates the steps until the power consumption level is calculated. FIG. 6 illustrates the steps until the details of the peak brightness control to be exercised based on the calculated power consumption level are determined.

First, the power consumption calculation section 3 converts the video signal (gray level) that is sequentially input into the current i (S1). Next, the same section 3 cumulatively adds up the current i for each pixel obtained by the conversion to calculate the total current I (S2).

After the total current I is calculated, the same section 3 multiplies the total current I by the supply voltage Vcc to calculate the power W consumed by displaying the video signal input from the beginning of each frame up to the time of calculation (S3). It should be noted that the power W is transmitted to the power consumption status determination section 5 each time it is updated. It should also be noted that the above processing steps are repeated.

Upon receipt of the current power consumption level W, the power consumption status determination section 5 determines whether the power consumption level W exceeds the allowable limit (S11).

When the power consumption level W remains below the allowable limit (when the determination is negative), the peak brightness control section 7 maintains the set peak brightness condition (S12).

That is, the same section 7 outputs the preset peak brightness condition to the organic EL panel module 9. Then, the same section 7 determines whether the frame period has ended. While the determination is negative, the same section 7 returns to step S11 (S13). Incidentally, if the determination is affirmative (if the frame has ended), the same section 7 resets the peak brightness condition to be ready for the processing in the next frame period.

On the other hand, if the power consumption level exceeds the allowable limit (if the determination is affirmative in step S11), the same section 7 changes the peak brightness condition to suit the detected timing (over-limit detection timing). In this case, the same section 7 changes the peak brightness condition so as to reduce the lighting time of the organic EL element per frame and outputs the changed condition to the organic EL panel module 9.

For example, the peak brightness condition is, changed so that the earlier the detection of the over-limit timing signal appears, the shorter the duty pulse length. It should be noted that the duty pulse is transmitted one line at a time to the next stage starting from the first line on the display panel in synchronism with the horizontal synchronizing pulse. Therefore, the duty pulse with a reduced lighting time propagates over the entire screen over one frame period. This translates to uniformly shorter lighting time of the horizontal lines, thus suppressing the power consumption during this period.

Moreover, for example, the earlier the detection of the over-limit timing signal appears, the earlier in the frame period the supply voltage Vcc is changed to 0 V. It should be noted that, in the case of an ordinary display panel, the supply voltage Vcc is applied commonly to all the pixels (all the organic EL elements). Therefore, if the supply voltage Vcc is changed to 0V, the entire screen is unlit (black screen) from the moment of change to the end of the frame. Although this causes the screen to look dark to the user, the power consumption can be positively suppressed.

The repetition of the above processing steps keeps down the power, consumption of the organic EL panel module 9. Further, the peak brightness control is carried out only if the power consumption level exceeds the allowable limit. Therefore, so long as the power consumption level remains below the allowable limit, the image will be displayed at the optimal quality under the preset peak brightness condition.

In addition, this processing method requires absolutely no frame memories. This ensures downsizing of the processing system. Therefore, if the power consumption controller 1 is incorporated in an organic EL display apparatus or other electronic equipment, it can be incorporated in part of the existing semiconductor circuitry. This eliminates the need to provide a new space or external wirings at the time of incorporation.

(B) Control Technique 2

Here, the second control technique proposed by the inventors will be described below. The second control technique employs the same procedures as the first technique with the exception of the concrete procedure for the peak brightness control. Therefore, the self-luminous display panel and the power consumption controller used remain unchanged in basic configuration from those in the control technique 1.

(B-1) Basic Configuration of the Power Consumption Controller

Figure 7:
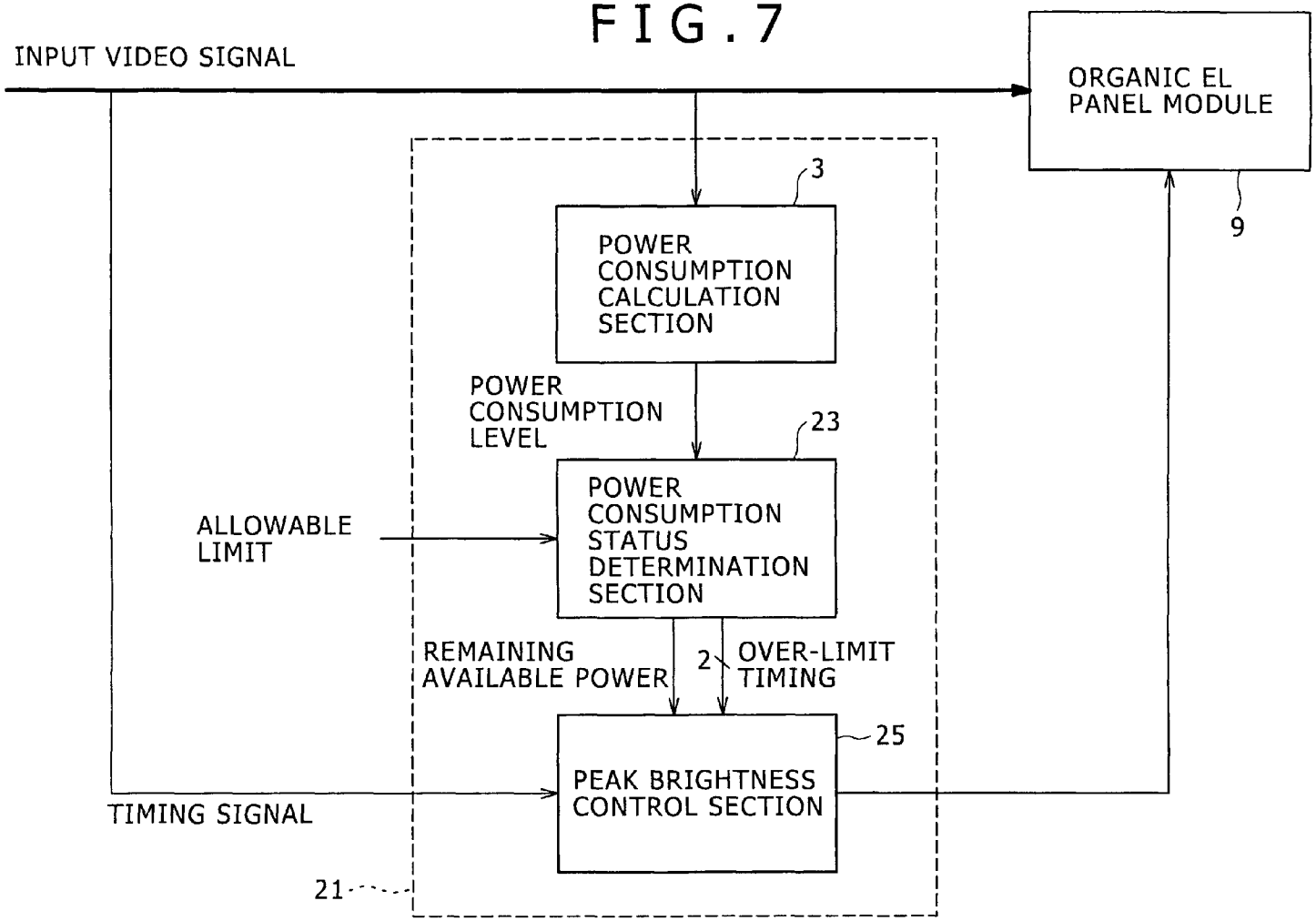
[FIG. 7]

FIG. 7 illustrates the basic configuration of a power consumption controller 21 proposed by the inventors. The same controller 21 includes three functional blocks, namely, the power consumption calculation section 3, a power consumption status determination section 23 and a peak brightness control section 25. A description will be made below about the power consumption status determination section 23 and the peak brightness control section 25.

The power consumption status determination section 23 is a processing device operable to determine whether the calculated power consumption level exceeds each of two reference values for comparison (allowable limit and half the allowable limit) by constantly comparing the power consumption level against each of the two reference values.

The power consumption status determination section calculates the difference between the current power consumption and the allowable limit if the power consumption level exceeds half the allowable limit. The same section 23 continues this calculation until the power consumption level exceeds the allowable limit. Also in this case, the timing at which the allowable limit is exceeded is determined on a pixel by pixel or horizontal line by horizontal line basis.

The peak brightness control section 25 is a processing device operable to control the peak brightness of the organic EL panel module 9 so that the peak brightness gradually decreases while the power consumption level exceeds half the allowable limit but not the allowable limit. The same section 25 does so based on a parameter indicating the point in time of processing (scan position/vertical resolution) and another parameter indicating available power (=(allowable limit-current power consumption level)/allowable limit).

It should be noted, however, the peak brightness control section 25 controls the peak brightness so as to reduce the brightness down to zero if it receives an input indicating that the power consumption level exceeds the allowable limit.

As described above, the peak brightness control section 25 differs from the counterpart used in the control technique 1 in that the same section 25 does not force the peak brightness down to zero, but instead controls the peak brightness in consideration of the current power consumption level, over-limit timing and other factors so that the peak brightness varies at a smaller rate and more mildly.

It should be noted that the peak brightness is controlled in the same manner as in the control technique 1. That is, the length of lighting time per frame (duty pulse length) is changed. Alternatively, the supply voltage required to light up and drive the organic EL element is sequentially changed.

Figures 8A, 8B, 8C, 8D:
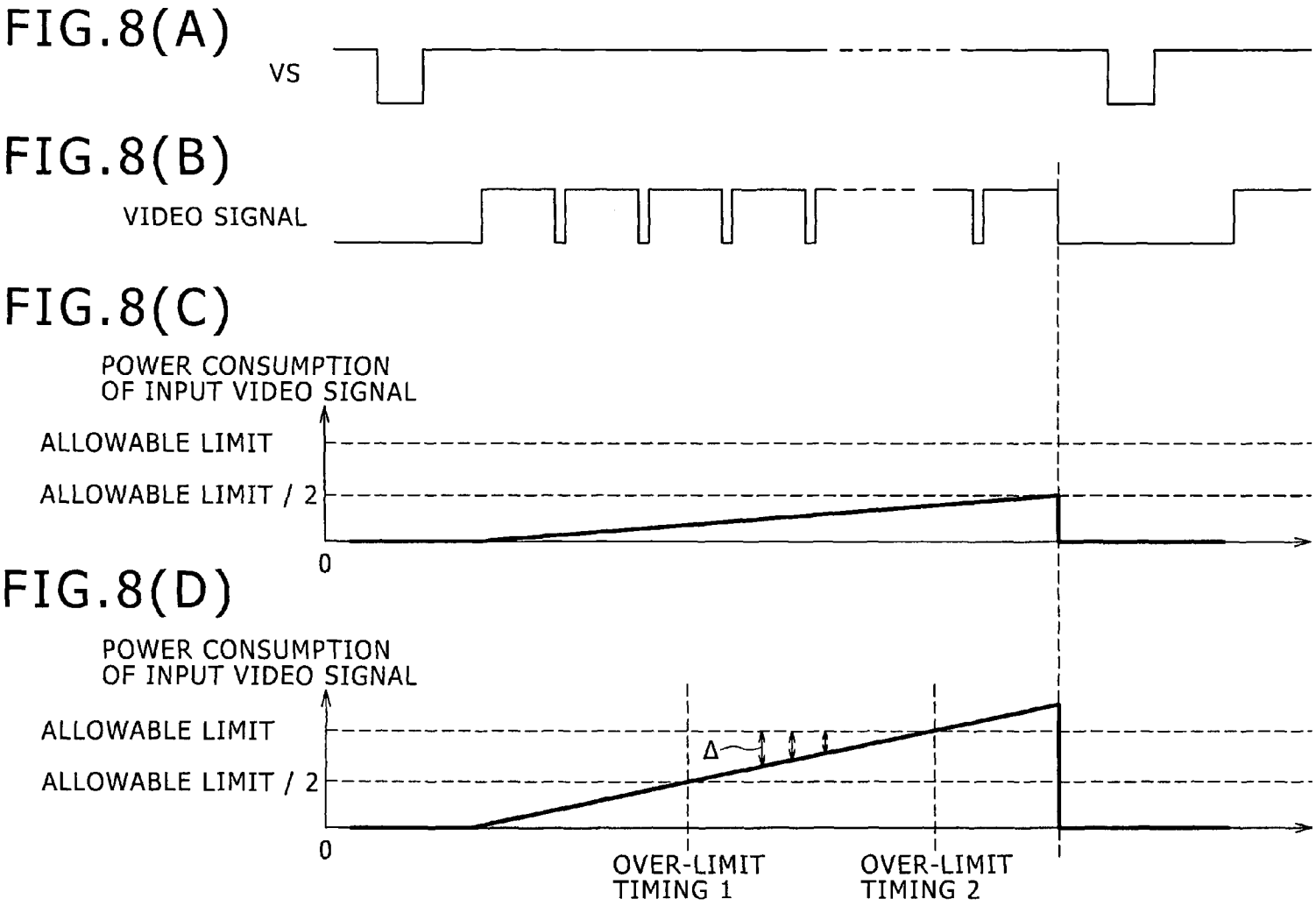
FIGS. 8(A) to 8(D) are views describing the determination carried out by the power consumption status determination section.

(a) Internal Configuration of the Power Consumption Status Determination Section FIGS. 8(A) to 8(D) illustrate the details of the processing performed by the power consumption status determination section 23. Incidentally, FIG. 8(A) illustrates the vertical synchronizing pulse VS adapted to give the start position of a frame. FIG. 8-(B) illustrates video signal trains which appear during a frame period. Video signal trains appear in synchronism with a horizontal synchronizing pulse. As many of signal trains as the vertical resolution appear.

FIGS. 8(C) and 8(D) illustrate the change in power consumption resulting from displaying the video signal input during a frame period.

FIG. 8(C) illustrates the case in which the power consumption calculated based on the video signal making up one frame remains below half the allowable limit. In this case, the power consumption status determination section 23 does not output any over-limit signal indicating that the allowable limit has been exceeded.

On the other hand, FIG. 8(D) illustrates the case in which the power consumption calculated based on the video signal making up one frame exceeds both half the allowable limit and the allowable limit halfway through a frame period. In this case, the power consumption status determination section 23 outputs an over-limit timing signal indicating that half the allowable limit or the allowable limit has been exceeded upon exceeding of each limit.

(B-2) Control Operation and Effects

A description will be made below about the power consumption control performed by the power consumption controller 21 having the above functional configuration in terms of the processing steps. It should be noted that the steps up to the calculation of the power consumption level are the same as in the control technique 1, and therefore the description thereof will be omitted.

Figure 9:
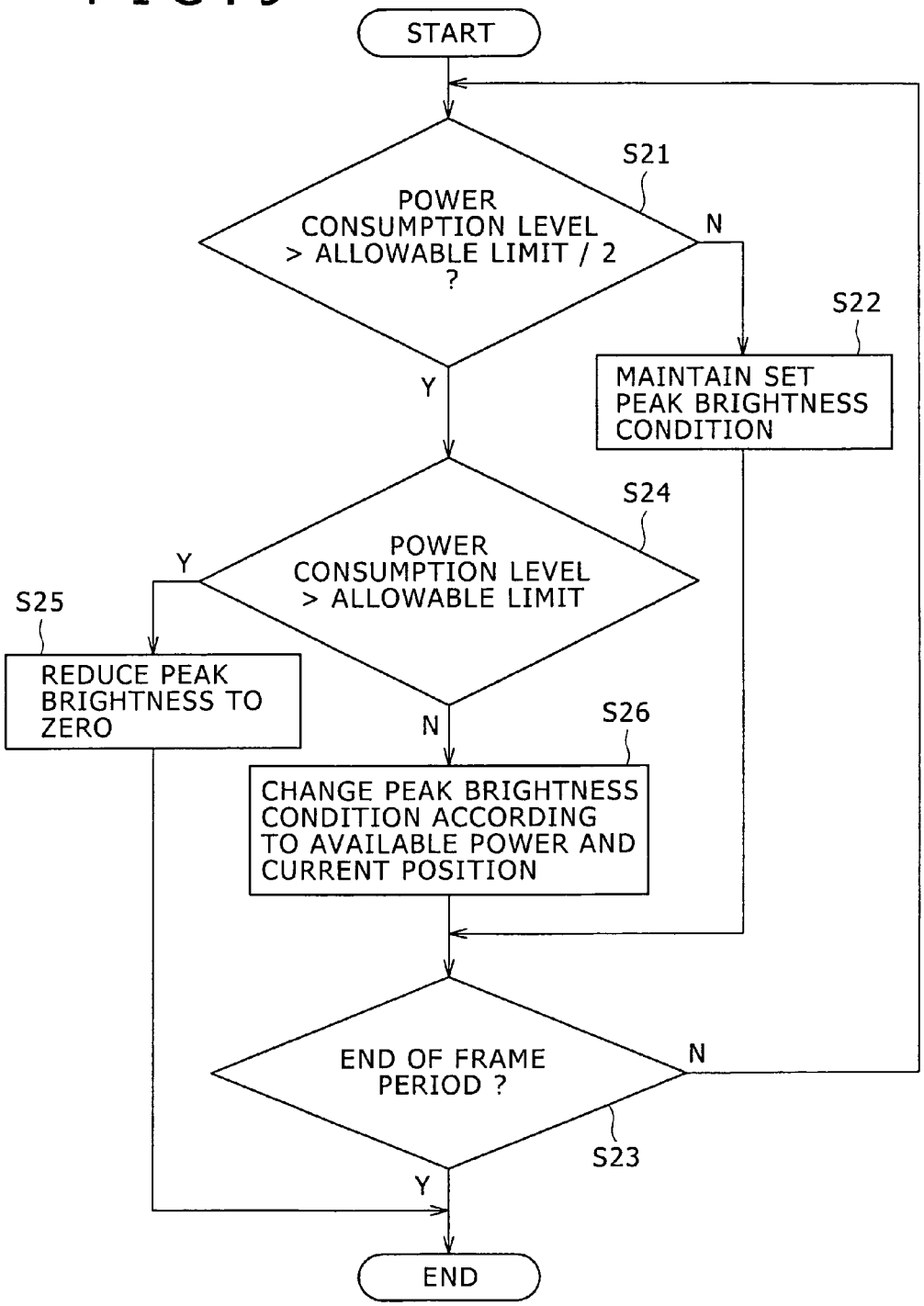
[FIG. 9]

FIG. 9 illustrates the steps after the power consumption level is calculated.

Upon receipt of the current power consumption level W, the power consumption status determination section 23 determines whether the power consumption level W exceeds half the allowable limit (S21).

When the power consumption level W remains below the allowable limit (when the determination is negative), the peak brightness control section 23 maintains the set peak brightness condition (S22).

That is, the same section 23 outputs the preset peak brightness condition to the organic EL panel module 9. Then, the same section 23 determines whether the frame period has ended. While the determination is negative, the same section 25 returns to step S21 (S23). Incidentally, if the determination is affirmative (if the frame has ended), the peak brightness control section 25 resets the peak brightness condition to be ready for the processing in the next frame period.

On the other hand, if the power consumption level exceeds half the allowable limit (if the determination is affirmative in step S21), the same section 25 further determines whether the power consumption level exceeds the allowable limit (S24).

If the determination is affirmative (if the power consumption level exceeds the allowable limit), the same section 25 reduces the peak brightness condition to zero (S25).

On the other hand, when the determination is negative (when half the allowable limit<power consumption<allowable limit), the same section 25 changes the peak brightness condition to match the available power and current position (S26).

Basically, the same section 25 controls the peak brightness so that the earlier the half the allowable limit is exceeded, the smaller the peak brightness so as to keep down power consumption thereafter.

Practically, the same section 25 employs these two control conditions in a combined manner to determine the peak brightness condition. As a result, the same section 25 controls the peak brightness so that the peak brightness gradually decreases between the set peak brightness and zero until the current power consumption level exceeds the allowable limit.

The repetition of the above processing steps is expected to basically provide the same effects as in the control technique 1. It should be noted that the present control technique does not reduce the peak brightness suddenly from the set brightness to zero, thus keeping image quality degradation to a minimum.

(C) Concrete Example

As a follow-up to the description given above, concrete examples of devices using the control techniques 1 and 2 will be described.

(C-1) Concrete Example 1 (Controlling the Duty Pulse Length Using the Control Technique 1)

Figure 10:
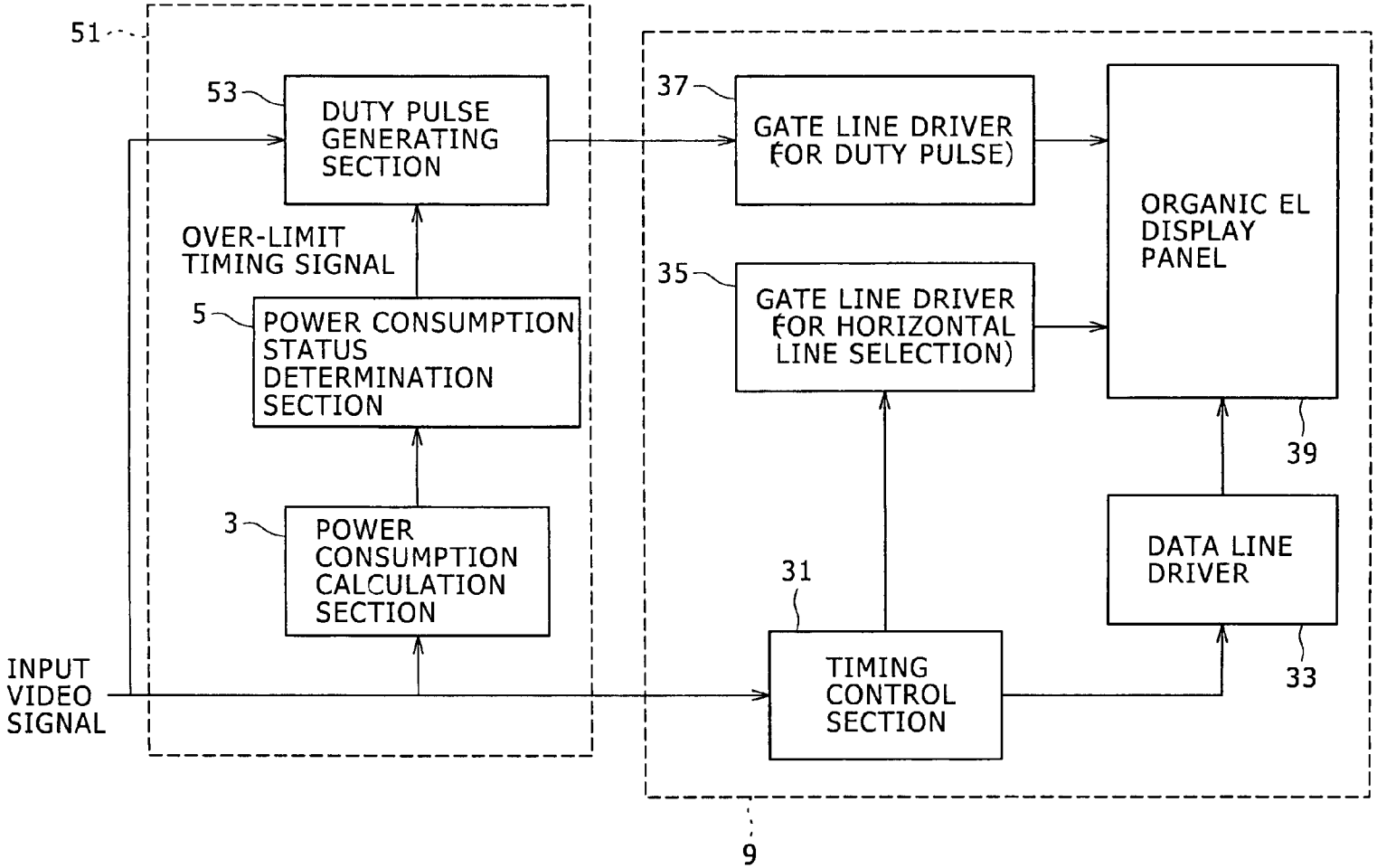
[FIG. 10]

FIG. 10 illustrates an example of a display apparatus which will be described in this concrete example. It should be noted that the same reference numerals as in FIG. 1 are used to denote the like components in FIG. 10. Here, the display apparatus includes the organic EL panel module 9 and a power consumption controller 51.

(a) Functional Configuration of the Organic EL Panel Module

First, a description will be made about a configuration example of the organic EL panel module 9 which is also used in other concrete examples.

The organic EL panel module 9 includes a timing control section 31, a data line driver 33, gate line drivers 35 and 37 and an organic EL display panel 39.

The timing control section 31 is a processing device operable to generate timing signals required for screen display based on a video signal.

The data line driver 33 is a circuit operable to drive data lines of the organic EL display panel 39. The same driver 33 converts the gray level which specifies the emission brightness of each pixel into an analog voltage level and supplies the voltage to the associated data line. The same driver 33 includes a well-known drive circuit.

The gate line driver 35 is a circuit operable to select and drive, through linear sequential scanning, a gate line provided for selection of a horizontal line to which to write the gray level. The same driver 35 includes a shift register having as many stages as the vertical resolution. A horizontal line selection signal is sequentially shifted in synchronism with a horizontal synchronizing pulse and applied through the register stages to the gate line which runs horizontally. The same driver 35 also includes a well-known drive circuit.

The gate line driver 37 is a circuit operable to drive, through linear sequential scanning, a gate line provided for transfer of a duty pulse. The same driver 37 also includes a shift register having as many stages as the vertical resolution. In this application example, a duty pulse is fed to the first stage of the register at every horizontal synchronization timing.

Figure 11:
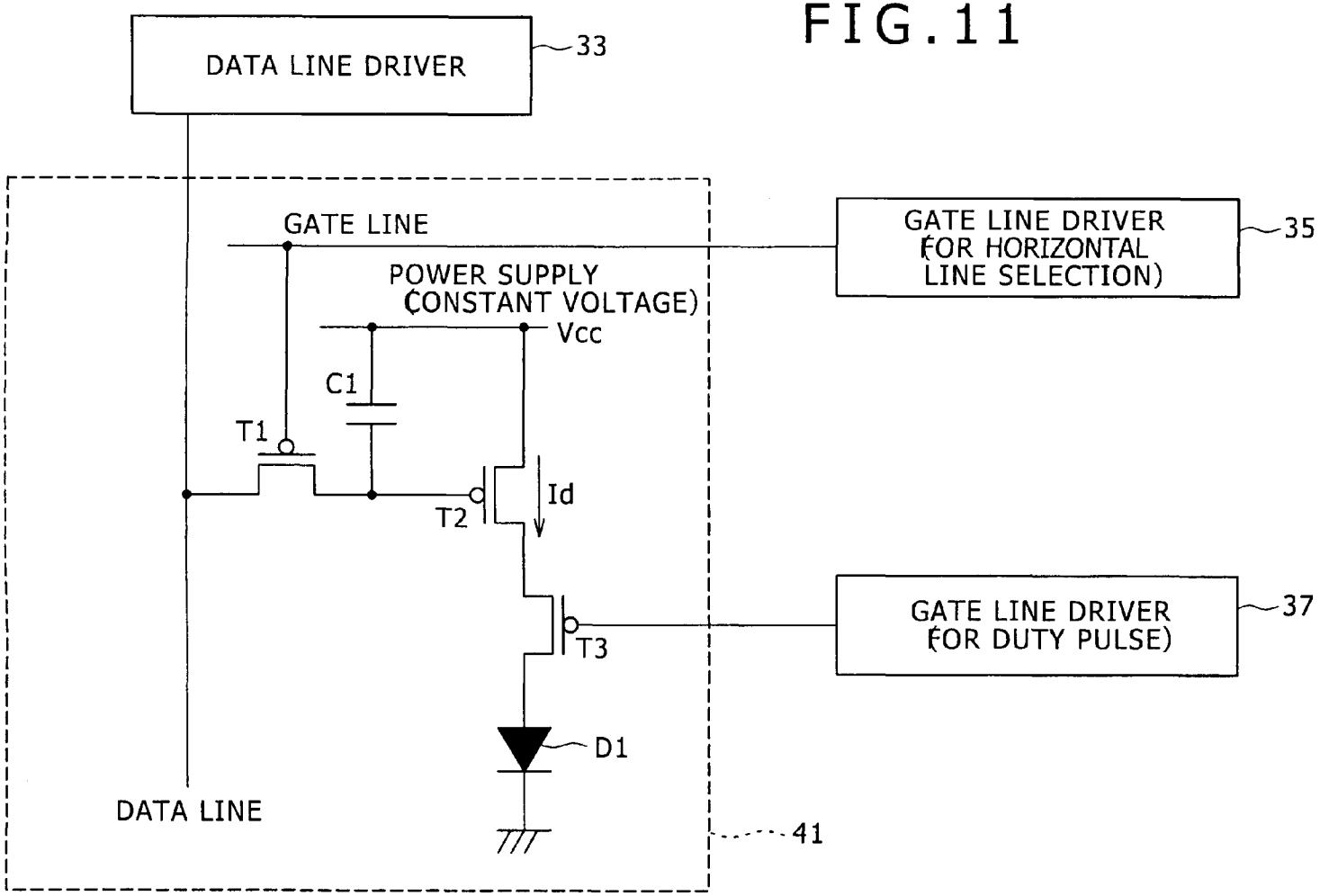
[FIG. 11]

The organic EL display panel 39 is a display device having display pixels arranged in a matrix form. FIG. 11 illustrates a circuit example of a display pixel 41. The display pixel 41 is disposed at an intersection between a data line and a gate line. The display pixel 41 includes a data switching element T1, a capacitor C1, a current supply element T2 and an emission period control element T3.

Here, the data switching element T1 is a transistor adapted to control the loading of a voltage level applied via the data line. The gate line driver 35 controls the loading timing.

The capacitor C1 is a storage element adapted to hold the loaded voltage level for a period of one frame. The capacitor C1 provides light emission as in frame sequential scanning.

The current supply element T2 is a transistor operable to supply a drive current commensurate with the voltage level of the capacitor C1 to an organic EL element D1.

The emission period control element T3 is a transistor operable to control the supply or interruption of drive current to the organic EL element D1.

The emission period control element T3 is disposed in series with the supply path of the drive current. The organic EL element D1 is lit while the same element T3 is on. On the other hand, the organic EL element D1 is unlit while the same element T3 is off.

Figures 12A, 12B:
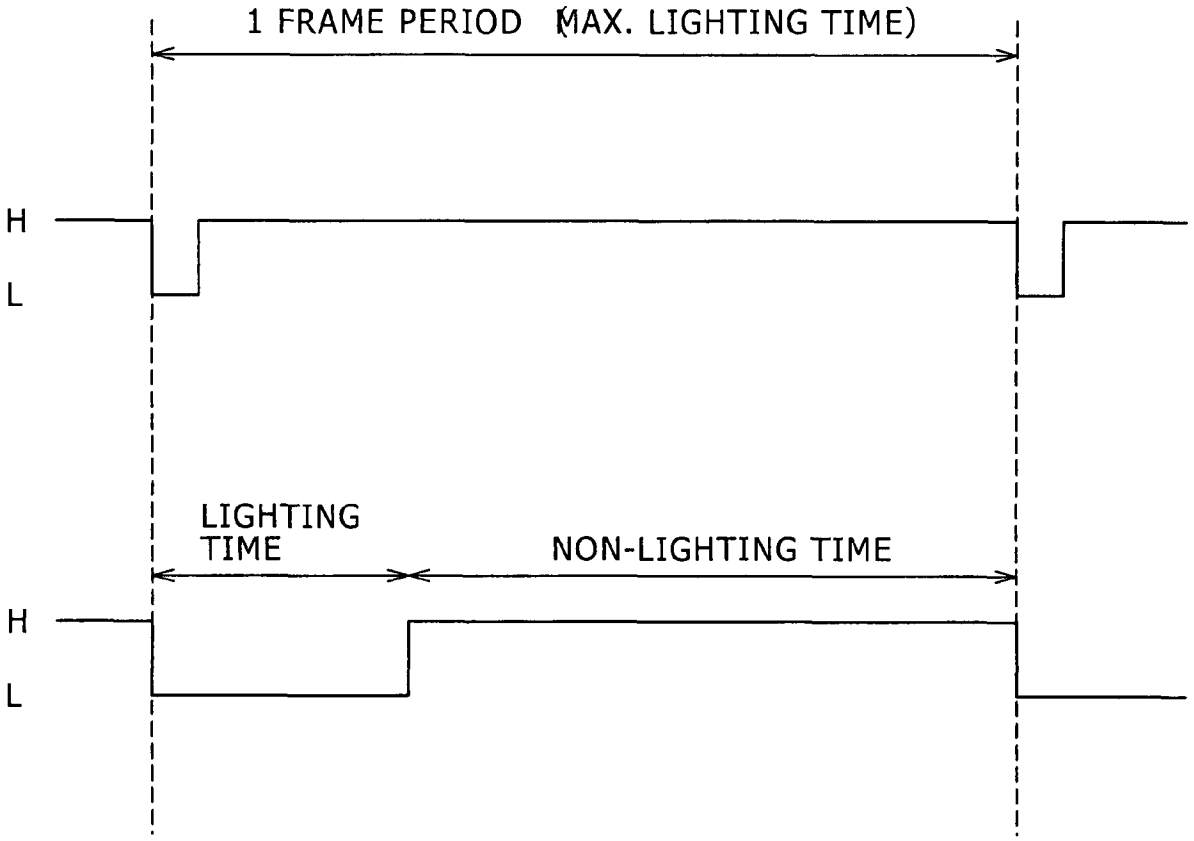
FIGS. 12(A) and 12(B) are views describing a duty pulse.

FIGS. 12(A) and 12(B) illustrate an example of duty pulse used in this concrete example. As illustrated in FIG. 12(B), the length of time during which the duty pulse is at low level corresponds to the lighting time of the organic EL element D1. It should be noted that the maximum lighting time of the same element D1 is one frame period as illustrated in FIG. 12(A). In the present concrete example, the preset duty pulse length is about 70% of the maximum lighting time.

(b) Functional Configuration of the Power Consumption Controller

A description will be made next about the functional block configuration of the power consumption controller 51. The same controller 51 includes three functional blocks, namely, the power consumption calculation section 3, the power consumption status determination section 5 and a duty pulse generating section 53. The component specific to the present concrete example is the duty pulse generating section 53. The same section 53 generates a set duty pulse or a duty pulse of arbitrary length and outputs the generated pulse to the organic EL panel module 9.

The duty pulse generated by the duty pulse generating section 53 is given to the gate line driver 37 in the organic EL panel module 9 to control the lighting time of the organic EL display panel 39. Naturally, the duty pulse is generated in synchronism with a vertical synchronizing pulse.

Figure 13:
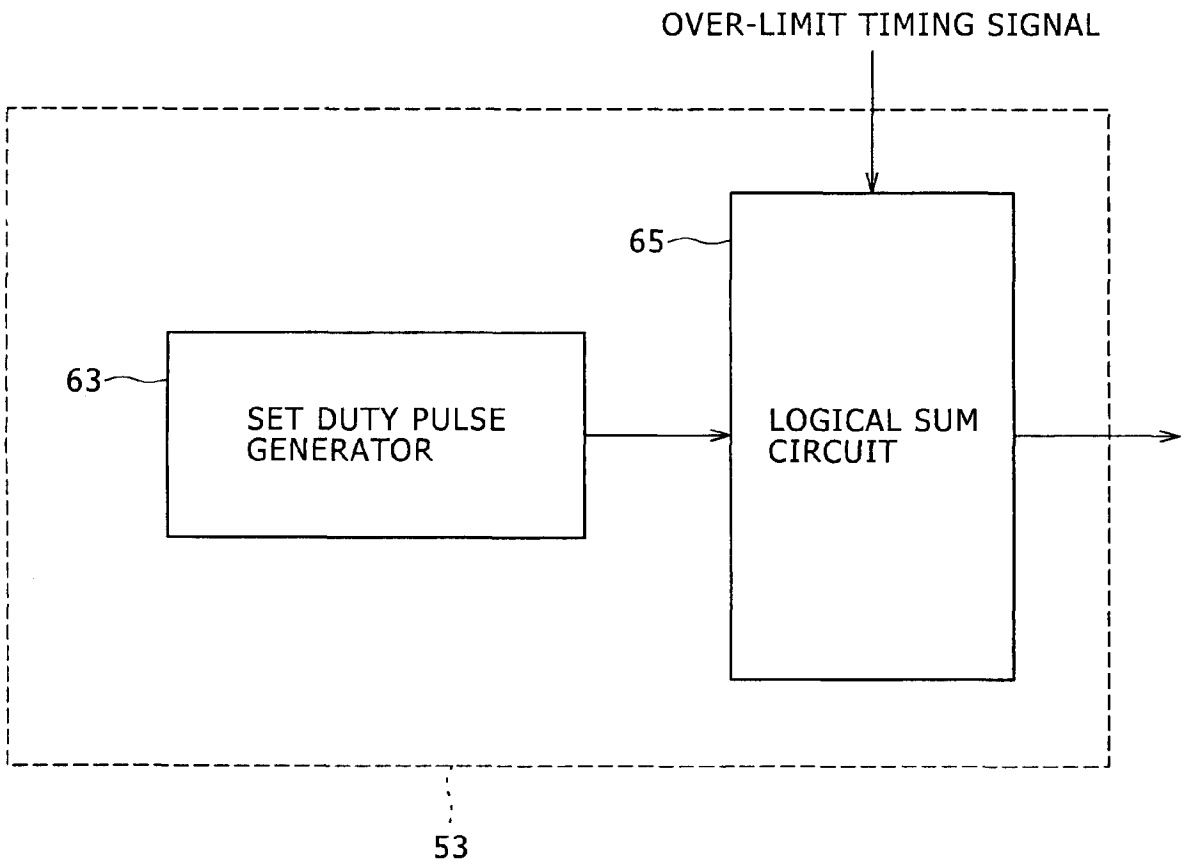
[FIG. 13]

FIG. 13 illustrates an example of internal configuration of the duty pulse generating section 53. The same section 53 includes two functional blocks, namely, a set duty pulse generator 61 and a logical sum circuit 63.

The set duty pulse generator 61 is a processing device operable to generate a duty pulse of preset fixed length.

The logical sum circuit 63 is a processing device operable to generate a duty pulse for control purposes by finding the logical sum of an over-limit timing signal and a set duty pulse. Incidentally, the over-limit timing signal is at low level until the power consumption level exceeds the allowable limit and maintained at high level after the allowable limit is exceeded.

Figures 14A, 14B, 14C, 14D:
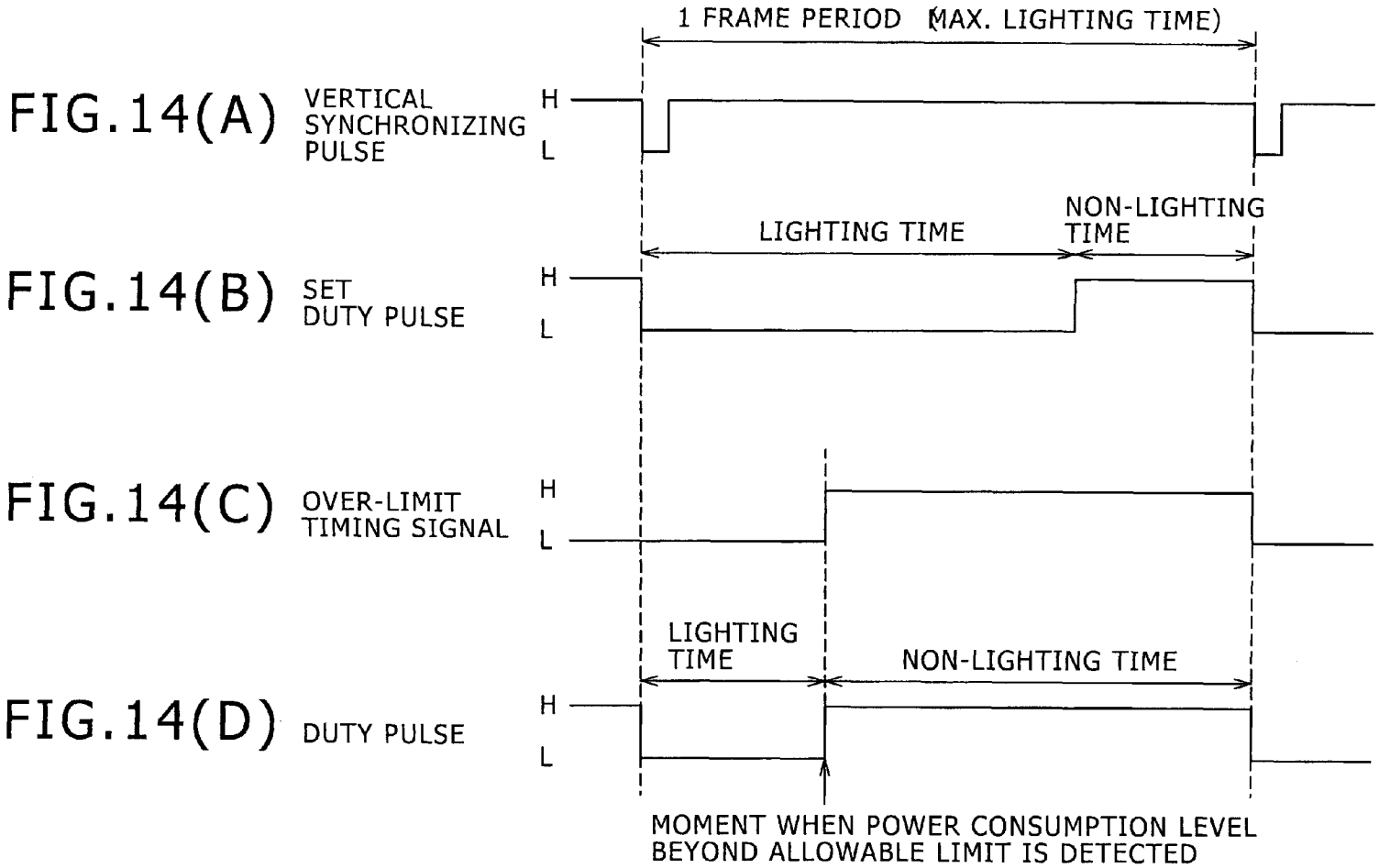
FIGS. 14(A) to 14(D) are views describing the details of control performed by the duty pulse generating section.

FIGS. 14(A) to 14(D) illustrate the details of operation of the duty pulse generating section 53. FIG. 14(A) illustrates the vertical synchronizing pulse VS adapted to give the start position of a frame. FIG. 14(B) illustrates the set duty pulse. FIG. 14(C) illustrates the over-limit timing signal output from the power consumption status determination section 5. FIG. 14(D) illustrates the duty pulse output from the logical sum circuit 63.

(c) Control Operation and Effects

Figures 15A, 15B, 15C, 15D:
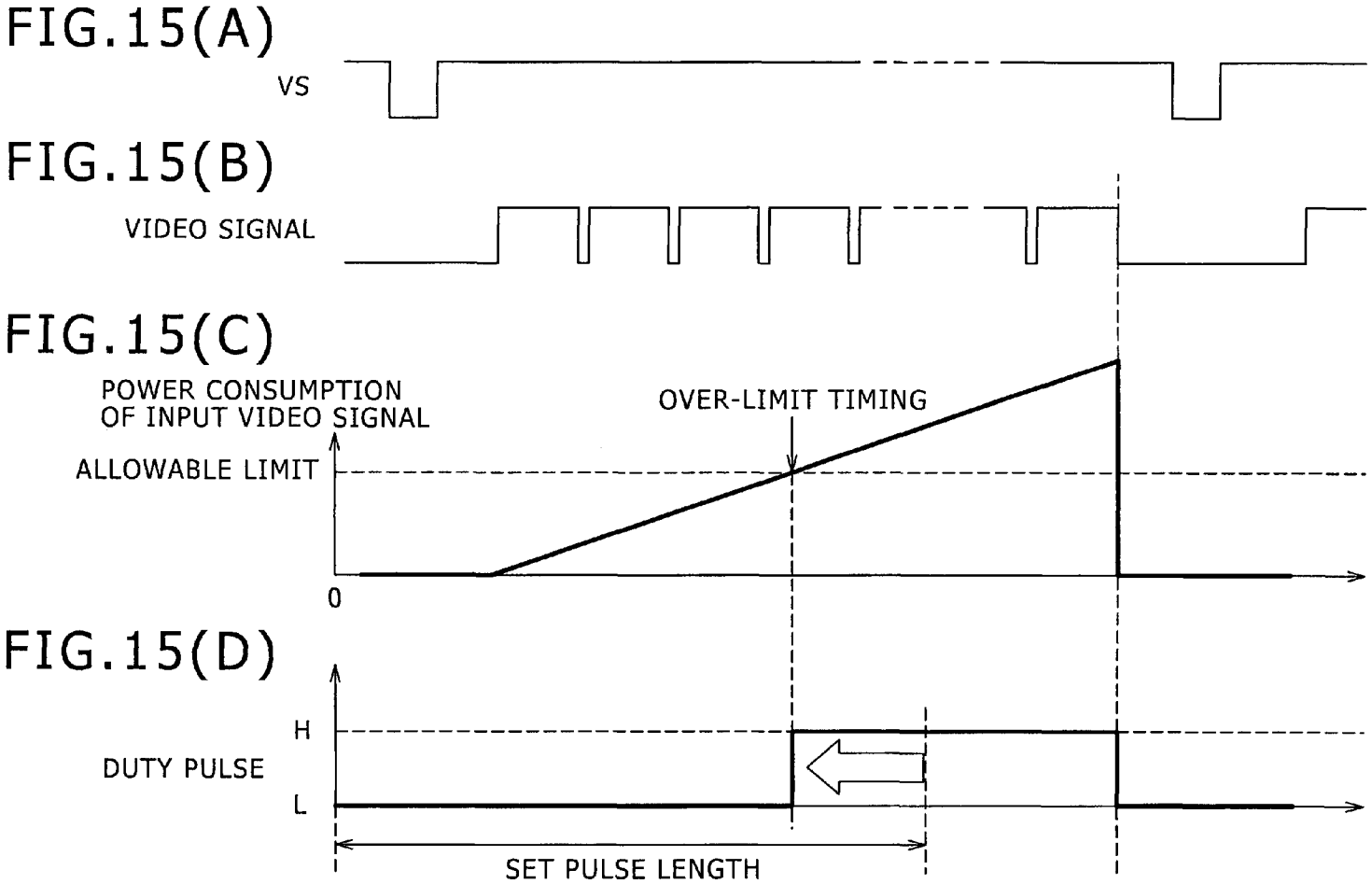
FIGS. 15(A) to 15(D) are views illustrating the relationship between the calculated power consumption level and the generated duty pulse length.

FIGS. 15(A) to 15(D) illustrates the relationship between the calculated power consumption level and the generated duty pulse length. FIG. 15(A) illustrates the vertical synchronizing pulse VS adapted to give the start position of a frame. FIG. 15(B) illustrates video signal trains which appear during a frame period. Video signal trains appear in synchronism with a horizontal synchronizing pulse. As many of signal trains as the vertical resolution appear.

FIG. 15(C) illustrates the change in power consumption level per frame calculated by the power consumption calculation section 3 based on the input video signal. FIG. 15(C) shows the case in which the calculated power consumption level exceeds the allowable limit earlier than the set pulse length.

FIG. 15(D) illustrates the duty pulse output from the duty pulse generating section 53.

As illustrated in FIG. 15(D), the duty pulse rises to high level when the power consumption level exceeds the allowable limit, considerably reducing the lighting time per frame period. Thus, the pulse length shorter than the set length keeps down the actual power consumption level.

It is to be noted that, in the present concrete example, the length of the duty pulse output from the duty pulse generating section 53 remains unchanged even if the power consumption level exceeds the allowable limit later than the set pulse length. Therefore, other control method is required to deal with the case as described above.

For example, a possible solution would be to express the timing at which the power consumption level exceeds the allowable limit within a frame period in percentage form and multiply the set pulse length by the percentage value. In this case, however, the control is delayed by one frame. Therefore, it is necessary, for example, to delay the video signal output by one frame.

(C-2) Concrete Example 2 (Controlling the Supply Voltage Using the Control Technique 1)

Figure 16:
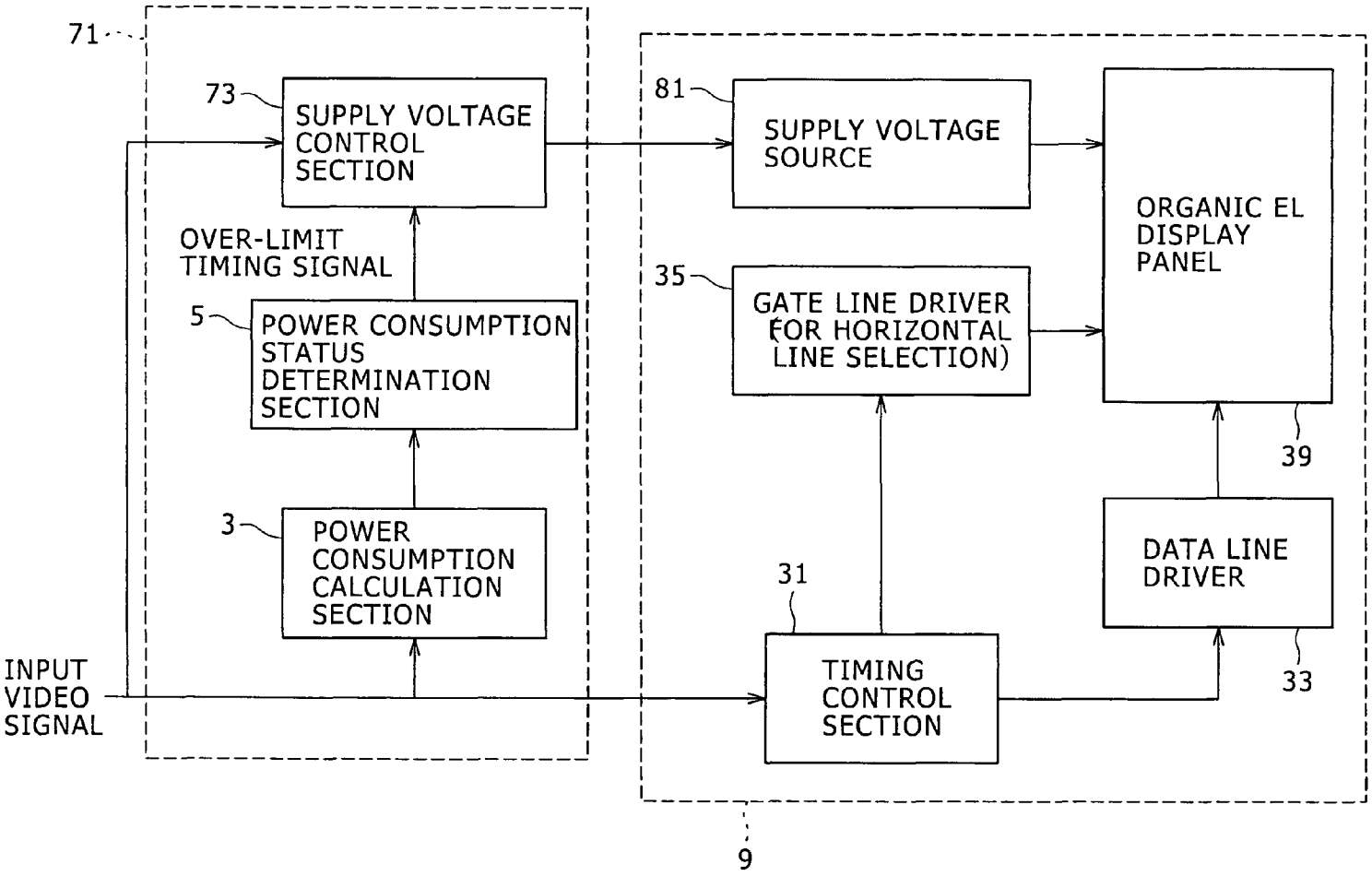
[FIG. 16]

FIG. 16 illustrates an example of a display apparatus described in this concrete example. It should be noted that, also in FIG. 16, the same reference numerals as in FIG. 1 are used to denote the like components. This display apparatus includes the organic EL panel module 9 and a power consumption controller 71.

(a) Functional Configuration of the Organic EL Panel Module

A configuration example of the organic EL panel module 9 will be described first. The organic EL panel module 9 includes the timing control section 31, the data line driver 33, the gate line driver 35, the organic EL display panel 39 and a supply voltage source 81.

The organic EL panel module 9 in the present concrete example is identical to that in the concrete example 1 except for the supply voltage source 81. Practically, however, a supply voltage source is provided in the concrete example 1. It should be noted that the supply voltage source in the concrete example 1 differs from that in the present concrete example in that it supplies voltage to both the capacitor C1 and the current supply element T2 and that the supply voltage level is fixed.

Figure 17:
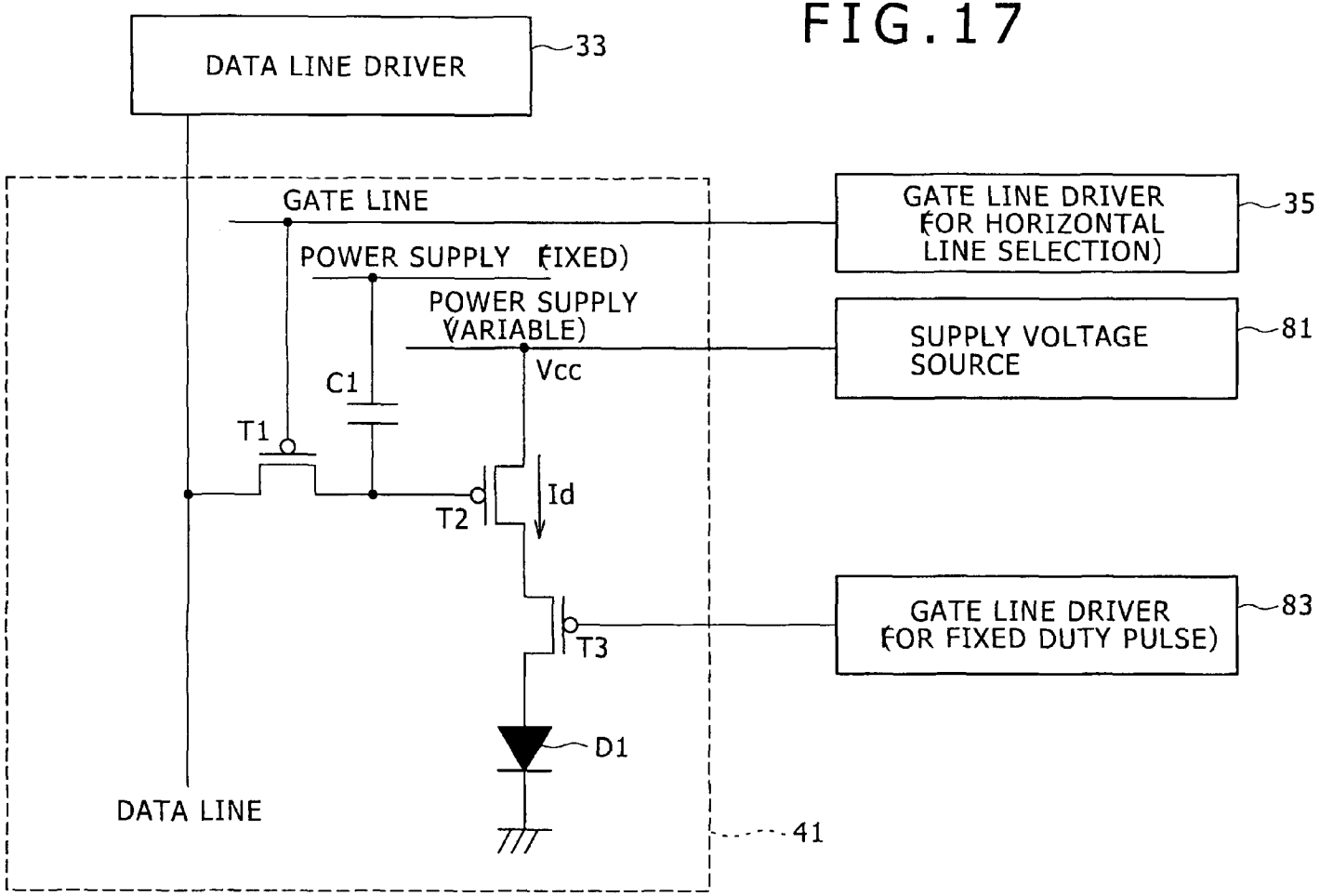
[FIG. 17]

FIG. 17 illustrates the connection between the organic EL panel module 9 and the display pixel in the present example. As illustrated in FIG. 17, the supply voltage generated by the supply voltage source 81 is applied only to one of the electrodes of the current supply element T2. It should be noted that a fixed potential is supplied to one of the electrodes of the capacitor C1 from a supply voltage source which is not shown.

Figures 18A, 18B, 18C:
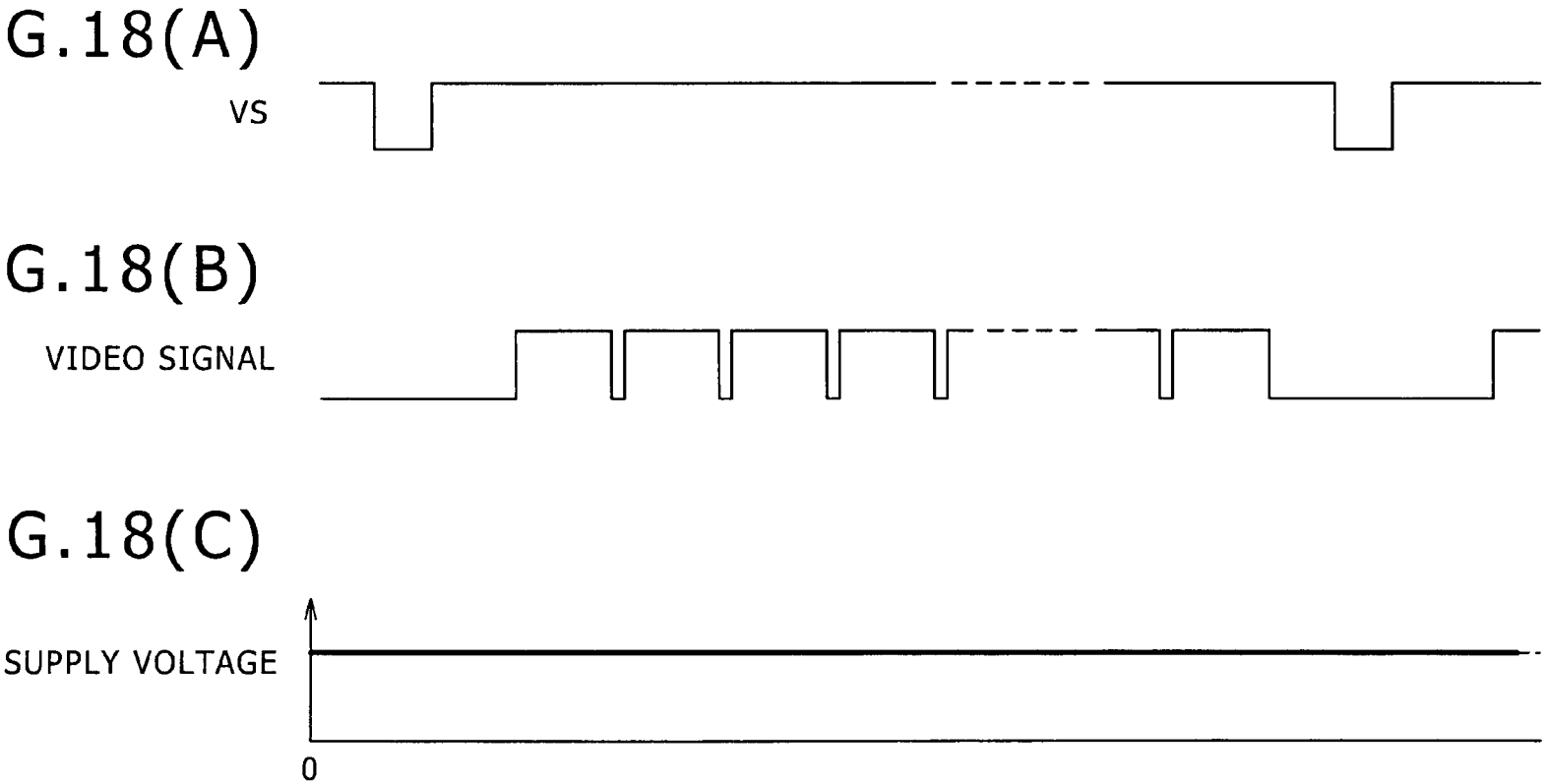
FIGS. 18(A) to 18(C) are views illustrating a basic example of supplying a supply voltage from a supply voltage source.

FIGS. 18(A) to 18(C) illustrate an example of supply voltage supplied from the supply voltage source 81. As illustrated in FIG. 18(C), a constant supply voltage is basically supplied to the power line. FIG. 18(A) illustrates the vertical synchronizing pulse VS adapted to give the start position of a frame. FIG. 18(B) illustrates video signal trains which appear during a frame period.

(b) Functional Configuration of the Power Consumption Controller

The functional block configuration of the power consumption controller 71 will be described below. The same controller 71 includes three functional blocks, namely, the power consumption calculation section 3, the power consumption status determination section 5 and a supply voltage control section 73.

The component specific to the present concrete example is the supply voltage control section 73. Although basically generating a constant voltage, the same section 73 forcefully resets the supply voltage level to zero from the moment when the power consumption level exceeds the allowable limit onward.

Figure 19:
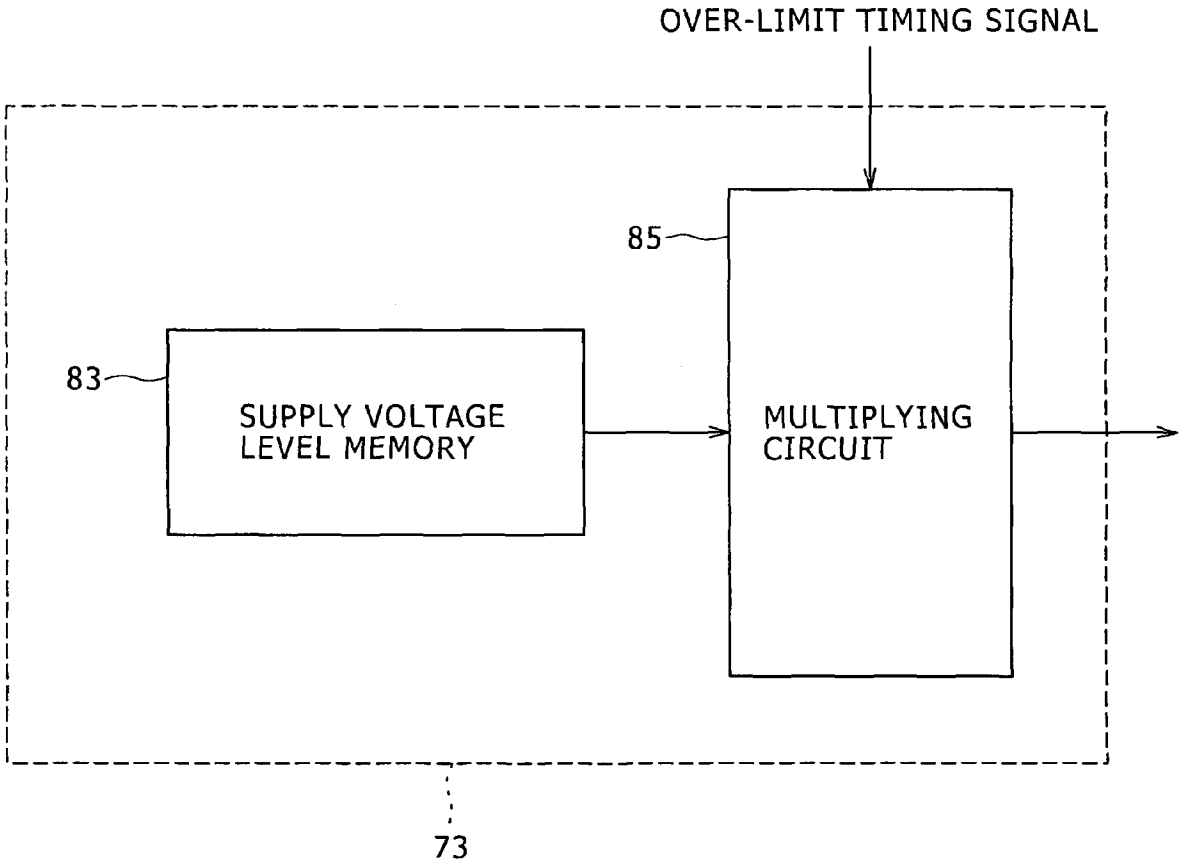
[FIG. 19]

FIG. 19 illustrates an example of internal configuration of the supply voltage control section 73. The supply voltage control section 73 includes two functional blocks, namely, a supply voltage level memory 83 and a multiplying circuit 85.

The supply voltage level memory 83 is a storage element adapted to store a supply voltage level determined in advance in consideration of the gamma characteristic of the organic EL element.

The multiplying circuit 85 is a processing device operable to multiply a set supply voltage level by an over-limit timing signal and output the result of multiplication as a supply voltage level. Incidentally, the over-limit timing signal is at high level until the power consumption level exceeds the allowable limit and is switched to low level after the allowable limit is exceeded.

FIGS. 20(A) to 20(C) illustrate the details of operation of the supply voltage control section 73. FIG. 20(A) illustrates the vertical synchronizing pulse VS adapted to give the start position of a frame. FIG. 20(B) illustrates the over-limit timing signal. FIG. 20(C) illustrates the supply voltage level output from the supply voltage control section 73.

(c) Control Operation and Effects

Figures 21A, 21B, 21C, 21D:
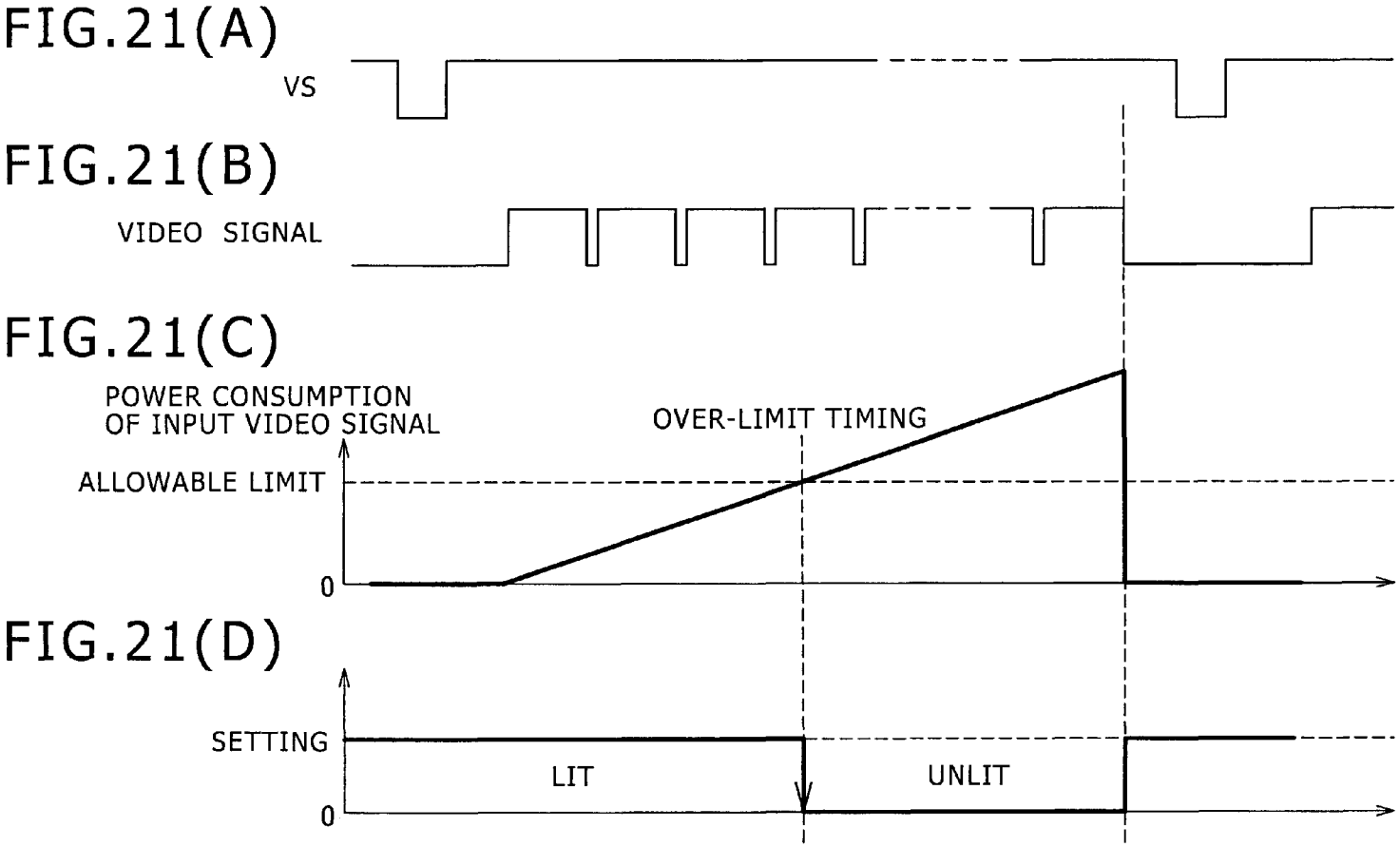
FIGS. 21(A) to 21(D) are views illustrating the relationship between the calculated power consumption level and the generated supply voltage.

FIGS. 21(A) to 21(D) illustrate the relationship between the calculated power consumption level and the generated supply voltage level. FIG. 21(A) illustrates the vertical synchronizing pulse VS adapted to give the start position of a frame. FIG. 21(B) illustrates video signal trains which appear during a frame period. Video signal trains appear in synchronism with a horizontal synchronizing pulse. As many of signal trains as the vertical resolution appear.

FIG. 21(C) illustrates the change in power consumption level per frame calculated by the power consumption calculation section 3 based on the input video signal. FIG. 21(C) shows the case in which the calculated power consumption level exceeds the allowable limit earlier than the set pulse length.

FIG. 21(D) illustrates the supply voltage level output from the supply voltage control section 73.

As illustrated in FIG. 21(D), the supply voltage level is forced down to zero when the power consumption level exceeds the allowable limit. This causes light emission of the entire screen to be halted until the termination of the frame.

This means that the lighting time per frame period is reduced considerably shorter than the set duty pulse length. Thus, if the power consumed by displaying the frame image exceeds the allowable limit, the screen is forced to turn off, positively keeping down the actual power consumption level.

In the present concrete example, the entire screen is turned off even if the power consumption level exceeds the allowable limit later than the set duty pulse length. In this regard, the reduction of power consumption is reflected earlier in the actual power consumption in the present concrete example than in the concrete example 1.

(C-3) Concrete Example 3 (Controlling the Supply Voltage Using the Control Technique 2)

Figure 22:
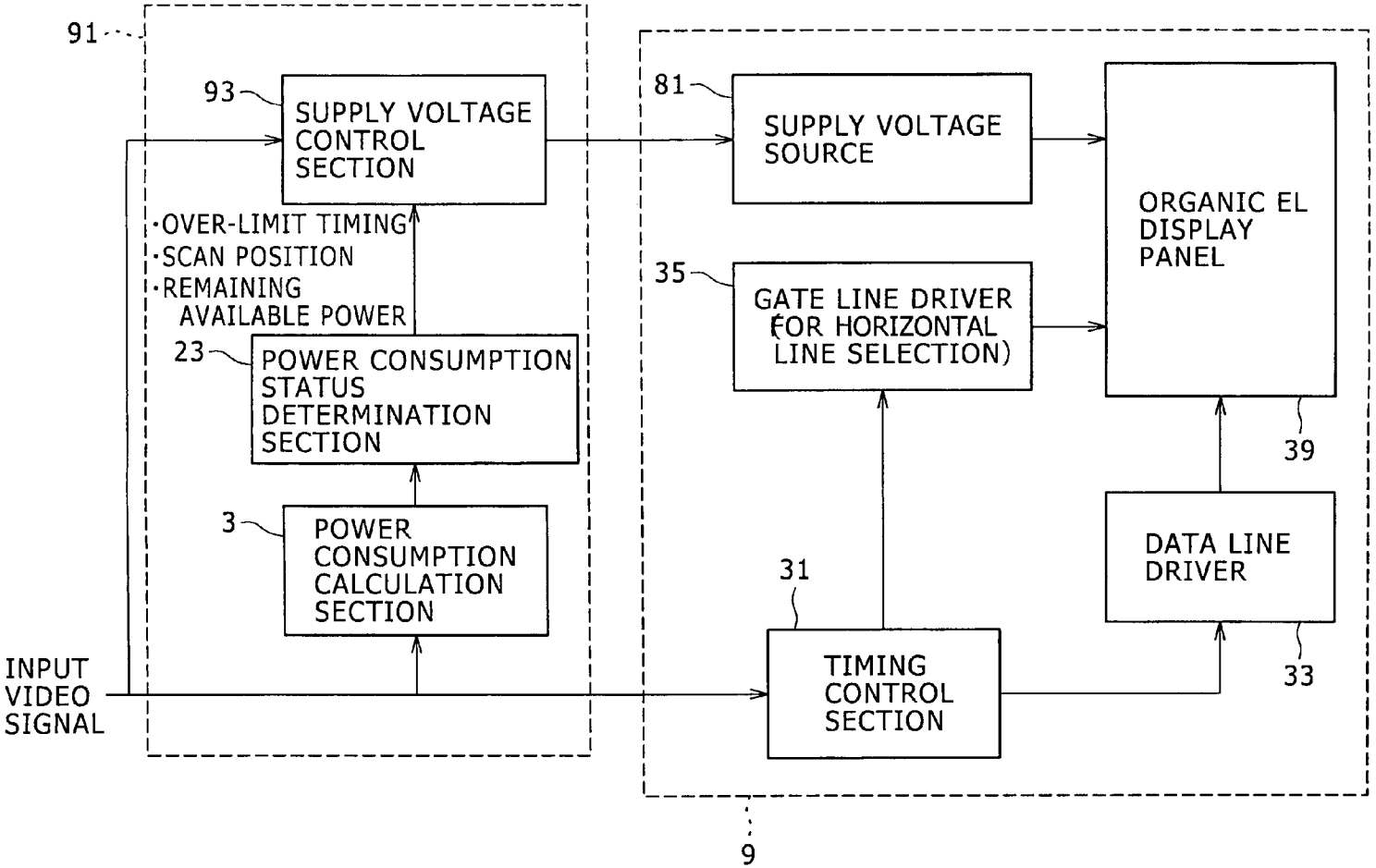
[FIG. 22]

FIG. 22 illustrates an example of a display apparatus described in this concrete example. It should be noted that the same reference numerals as in FIGS. 7 and 16 are used to denote the like components in FIG. 22. This display apparatus includes the organic EL panel module 9 and a power consumption controller 91. The organic EL panel module 9 includes the same components as those described in the concrete example 2.

(a) Functional Configuration of the Power Consumption Controller

The functional block configuration of the power consumption controller 91 will be described below. The same controller 91 includes three functional blocks, namely, the power consumption calculation section 3, the power consumption status determination section 23 and a supply voltage control section 93.

The component specific to the present concrete example is the supply voltage control section 93. Although basically generating a constant voltage, the same section 93 operates so that the smaller the difference between the power consumption level at the time of calculation and the allowable limit, the more the same section 93 reduces the supply voltage level from the moment when the power consumption level exceeds half the allowable limit onward.

Figure 23:
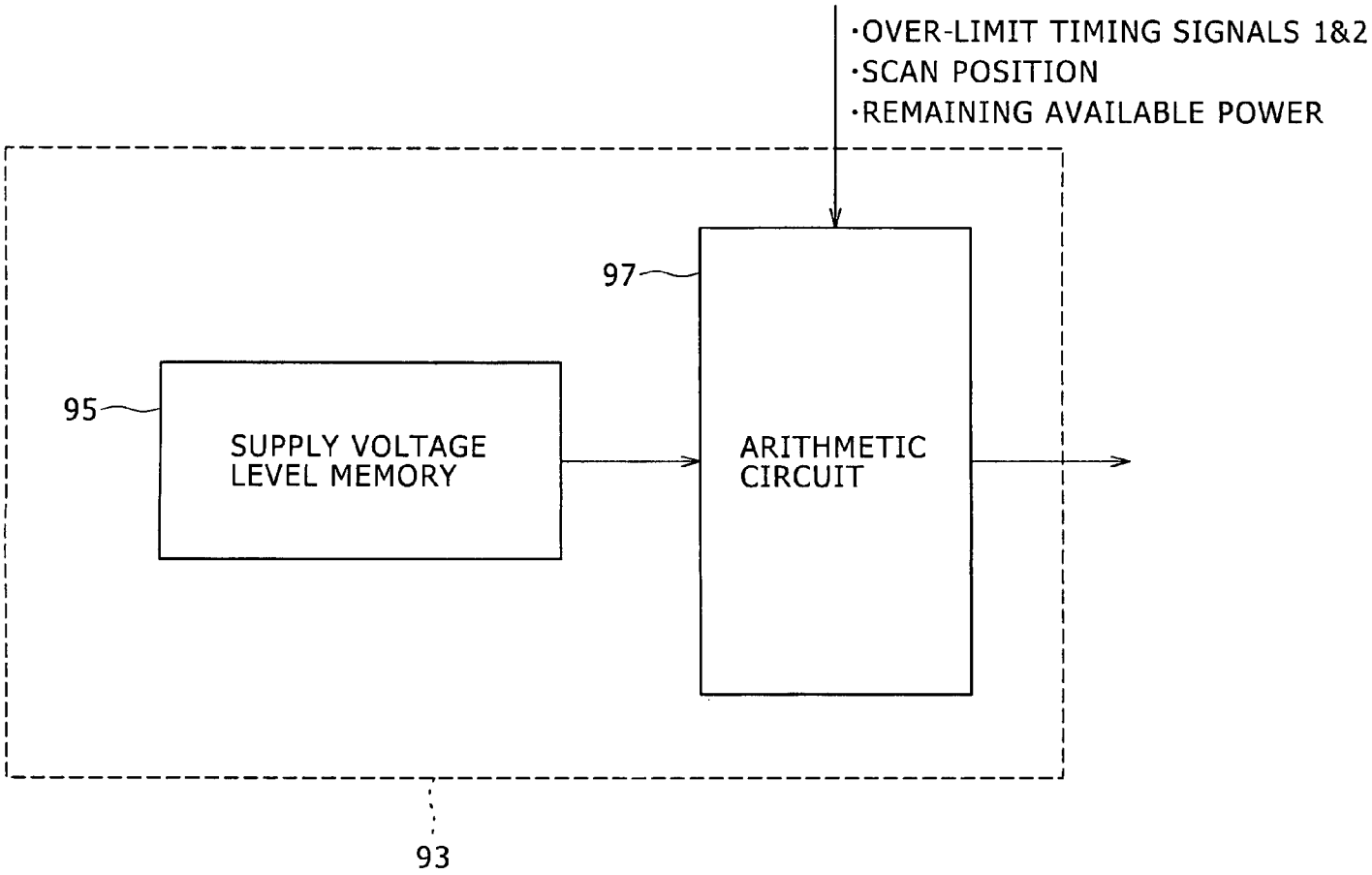
[FIG. 23]

FIG. 23 illustrates an example of internal configuration of the supply voltage control section 93. The same section includes two functional blocks, namely, a supply voltage level memory 95 and an arithmetic circuit 97.

The supply voltage level memory 95 is a storage element adapted to store a supply voltage level determined in advance in consideration of the gamma characteristic of the organic EL element.

The arithmetic circuit 97 is a processing device operable to output an appropriate supply voltage level based on the relationship in magnitude between a power consumption level Wnow at the time of calculation and two reference values for comparison (allowable limit and half the allowable limit). In this case, while the power consumption level Wnow remains below half the allowable limit, the arithmetic circuit 97 outputs the setting read from the supply voltage level memory 95 as is.

On the other hand, while the power consumption level Wnow exceeds half an allowable limit L but not the allowable limit L, the arithmetic circuit 97 outputs the supply voltage level calculated by the equation given below.

$$\text{Supply voltage level}=((L-W\text{now})/L)\times(\text{Scan position}/\text{Vertical resolution})\times\text{Set voltage level}$$

In this case, the scan position is given as the position relative to the first horizontal line at the time of calculation of the power consumption level Wnow. The earlier the power consumption level Wnow exceeds half the allowable limit L, the smaller the multiplier in the second term (=Scan position/Vertical resolution).

Figures 24, 24A, 24C:
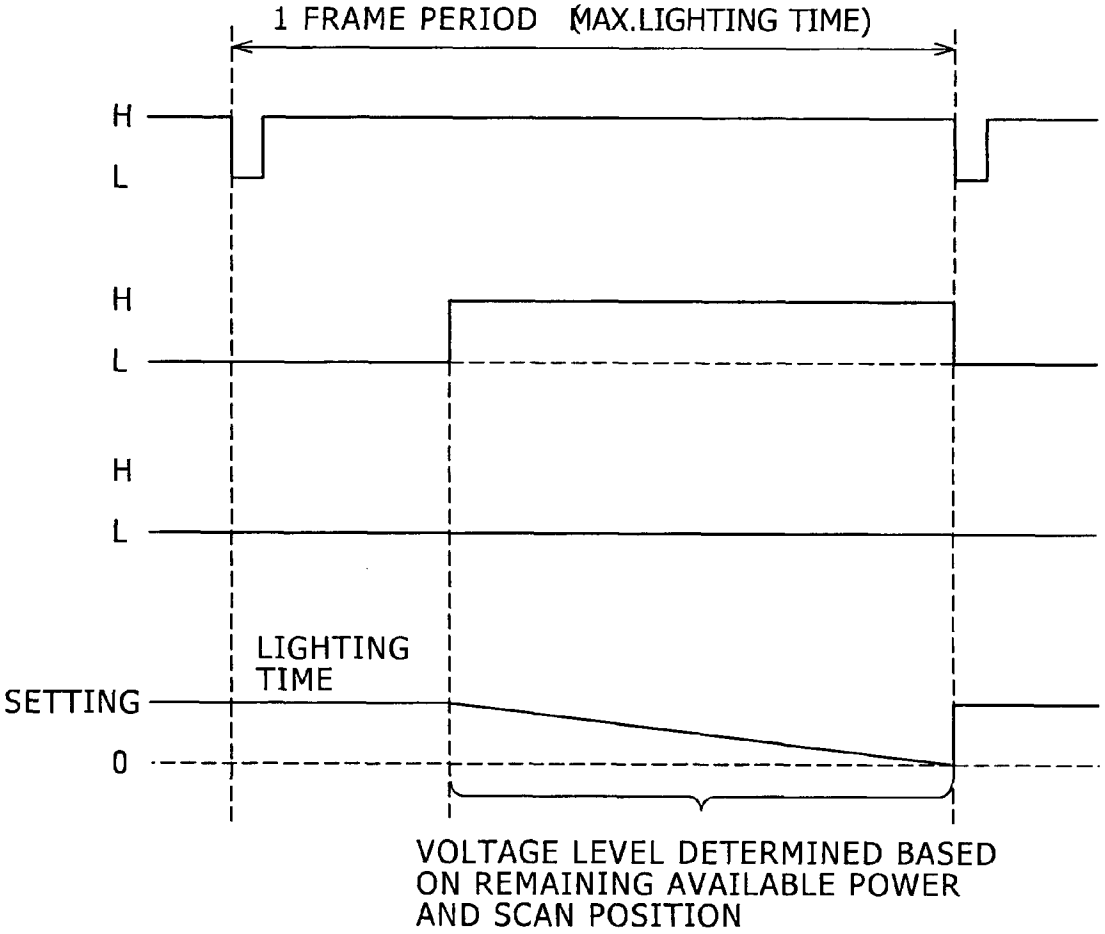

FIGS. 24(A) to 24(C) and 25(A) to 25(C) illustrate the details of operation of the supply voltage control section 93. Incidentally, FIGS. 24(A) to 24(C) are associated with the case in which the power consumption level Wnow exceeds half the allowable limit L but not the allowable limit L until the end of the frame. FIGS. 25(A) to 25(C) are associated with the case in which the power consumption level Wnow exceeds the allowable limit L before the end of the frame.

FIGS. 24(A) and 25(A) illustrate the vertical synchronizing pulse VS adapted to give the start position of a frame. FIGS. 24(B1) and 25(B1) illustrate an over-limit timing signal 1 adapted to give the timing at which the power consumption level Wnow exceeds half the allowable limit L. FIGS. 24(B2) and 25(B2) illustrate an over-limit timing signal 2 adapted to give the timing at which the power consumption level Wnow exceeds the allowable limit L.

In FIGS. 24(B1) to 24(B2), only the over-limit timing signal 1 changes from low to high level halfway through the frame. In contrast, in FIGS. 25(B1) to 25(B2), both the over-limit timing signals 1 and 2 change from low to high level halfway through the frame.

FIGS. 24(C) and 25(C) illustrate the supply voltage level output from the supply voltage control section 93.

As illustrated in FIGS. 24(C) and 25(C), the supply voltage level changes not in a binary manner but continuously to approach zero. Incidentally, if the power consumption level Wnow remains below the allowable limit L at the end of the frame, the supply voltage level changes so as to approach the level calculated according to the difference between the power consumption level Wnow and the allowable limit L. In any case, the brightness of the entire screen will drop uniformly. This minimizes image quality degradation as compared to the case where the screen is turned off in a binary manner.

(c) Control Operation and Effects

Figures 26A, 26B, 26C, 26D:
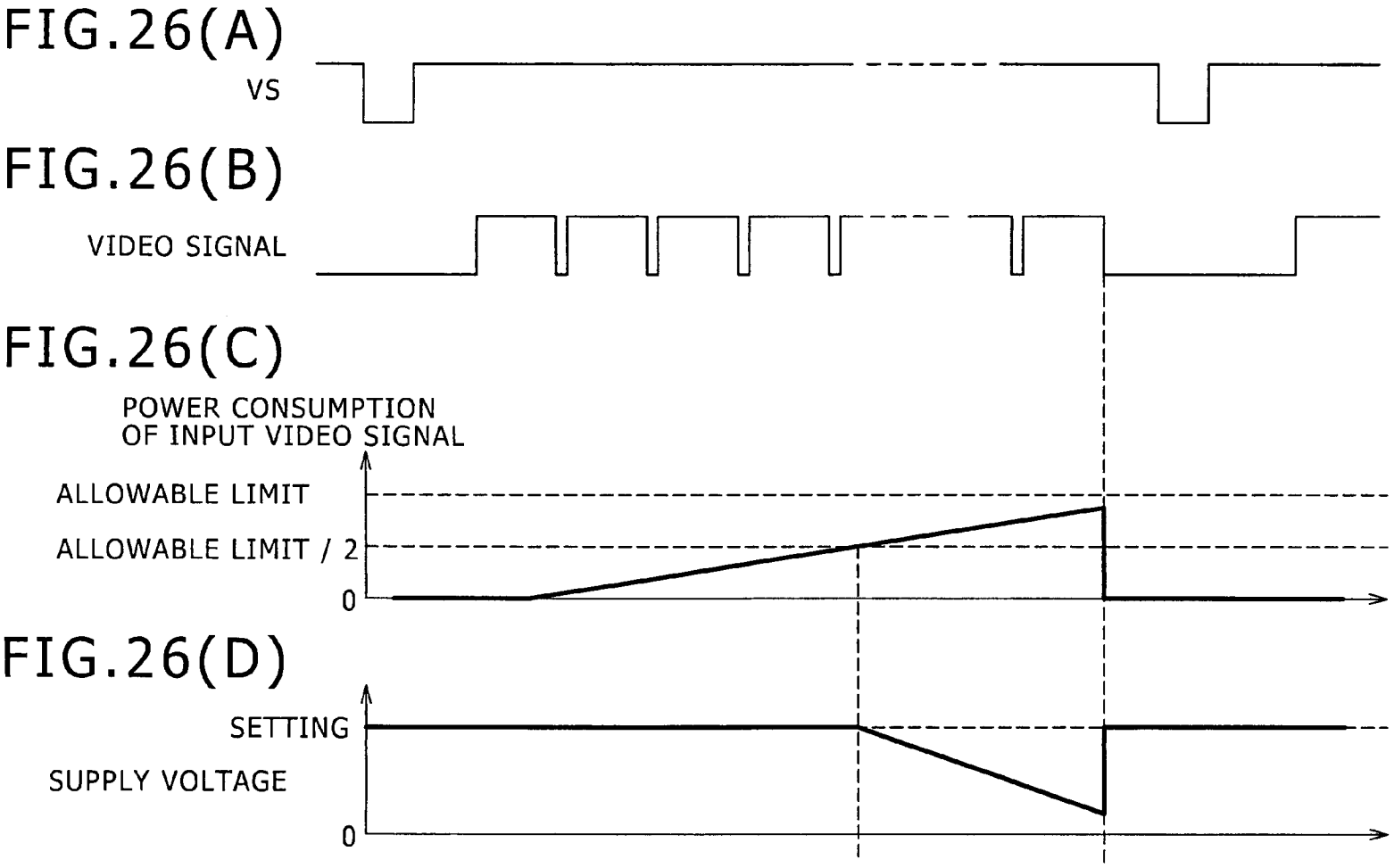
FIGS. 26(A) to 26(D) are views illustrating the relationship between the calculated power consumption level and the generated supply voltage.
Figures 27A, 27B, 27C, 27D:
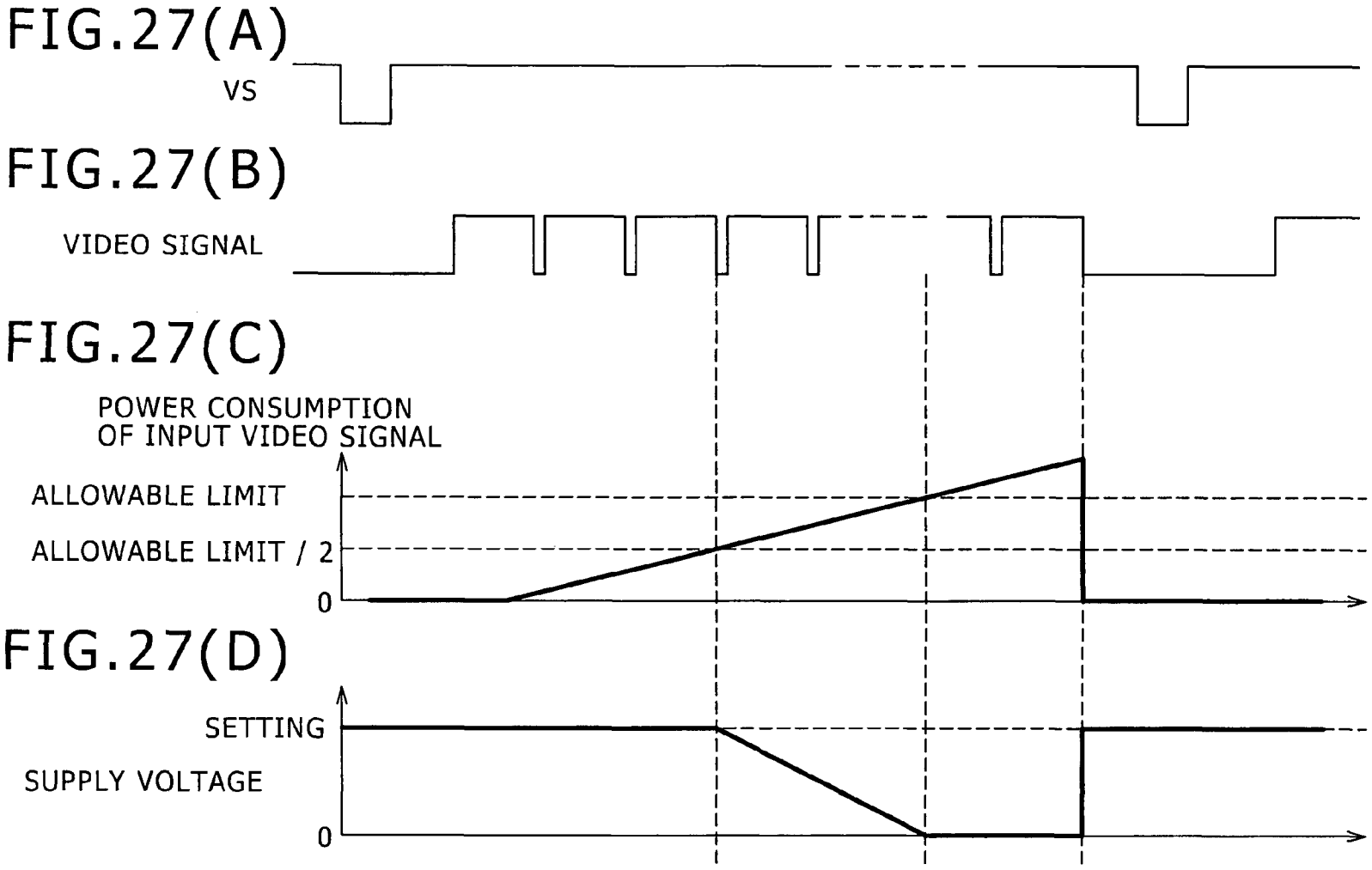
FIGS. 27(A) to 27(D) are views illustrating the relationship between the calculated power consumption level and the generated supply voltage.

FIGS. 26(A) to 26(D) and 27(A) to 27(D) illustrate the relationship between the calculated power consumption level and the generated supply voltage level. FIGS. 26(A) and 27(A) illustrate the vertical synchronizing pulse VS adapted to give the start position of a frame. FIGS. 26(B) and 27(B) illustrate video signal trains which appear during a frame period. Video signal trains appear in synchronism with a horizontal synchronizing pulse. As many of signal trains as the vertical resolution appear.

FIGS. 26(C) and 27(C) illustrate the change in power consumption level per frame calculated by the power consumption calculation section 3 based on the input video signal. FIG. 26(C) is associated with the case where the power consumption level does not exceed the allowable limit until the end of the frame. FIG. 27(C) is associated with the case where the power consumption level exceeds the allowable limit before the end of the frame.

FIGS. 26(D) and 27(D) illustrate the supply voltage level output from the supply voltage control section 73.

In FIG. 26(D), the power consumption level Wnow remains below the allowable limit L at the end of the frame. Therefore, the supply voltage level changes so as to approach the level calculated according to the final difference between the power consumption level Wnow and the allowable limit L. It should be noted that the organic EL element is illuminated by the duty pulse as well. Therefore, the supply voltage control is reflected only until the duty pulse remains at high level.

In FIG. 27(D), on the other hand, the power consumption level Wnow exceeds the allowable limit L at the end of the frame. Therefore, the supply voltage level drops from the setting down to zero before the end of the frame and remains at zero until the end of the frame thereafter. Also in this case, the organic EL element is illuminated by the duty pulse as well. Therefore, the supply voltage control is reflected only until the duty pulse is switched to low level or the supply voltage level reaches zero, whichever comes earlier.

In any case, the screen brightness is continuously reduced within a frame period, thus avoiding image quality degradation due to sudden decline in screen brightness. Naturally, if the power consumed by displaying the frame image exceeds the allowable limit, the entire screen is forced to turn off, positively keeping down the actual power consumption level.

(D) OTHER EMBODIMENTS (D-1) Examples of Incorporation

Here, examples of incorporating the above-mentioned power consumption controller in other devices will be described.

(a) Self-Luminous Display Apparatus

Figure 28:
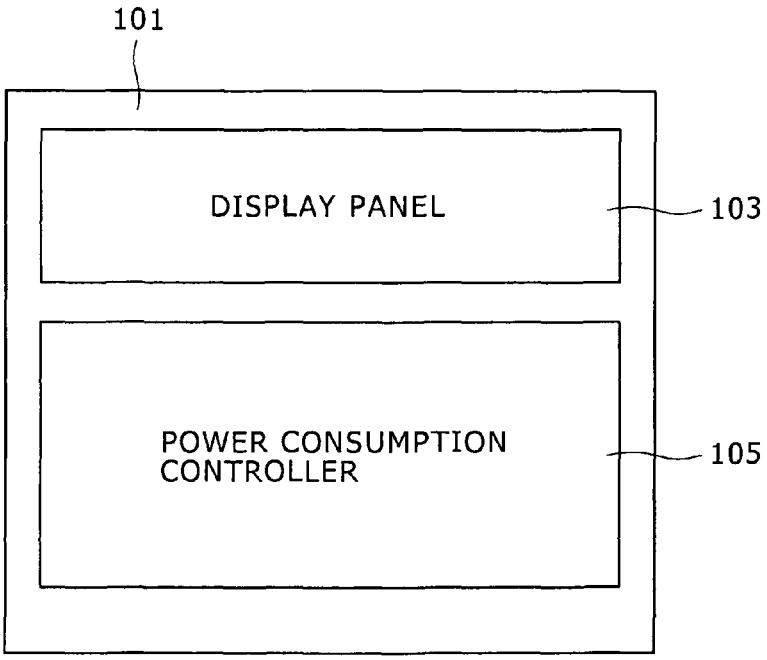
[FIG. 28]

The aforementioned power consumption controller may be incorporated in a self-luminous display apparatus (including a panel module) 101 as illustrated in FIG. 28.

The self-luminous display apparatus 101 illustrated in FIG. 28 includes a display panel 103 and a power consumption controller 105.

(b) Image Processor

Figure 29:
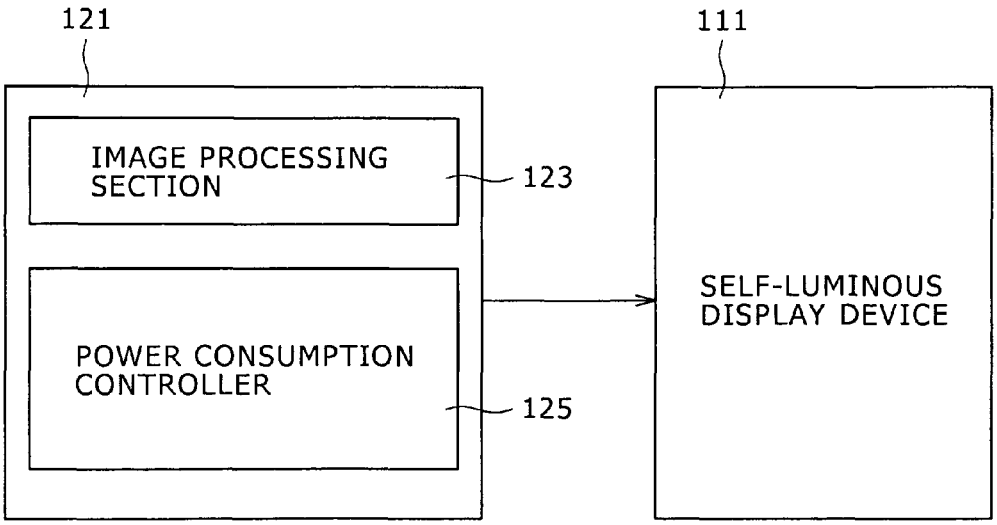
[FIG. 29]

The aforementioned power consumption controller may be incorporated in an image processor 121 as illustrated in FIG. 29. The image processor 121 supplies a video signal to a self-luminous display apparatus 111.

The image processor 121 illustrated in FIG. 29 includes an image processing section 123 and a power consumption controller 125.

(c) Electronic Equipment

The aforementioned power consumption controller may be incorporated in various types of electronic equipment incorporating a self-luminous display apparatus, irrespective of whether the electronic equipment is portable or stationary. Further, the self-luminous display apparatus need not necessarily be incorporated in the electronic equipment.

(c1) Broadcast Wave Receiver

The aforementioned power consumption and peak brightness controllers may be incorporated in a broadcast wave receiver.

Figure 30:
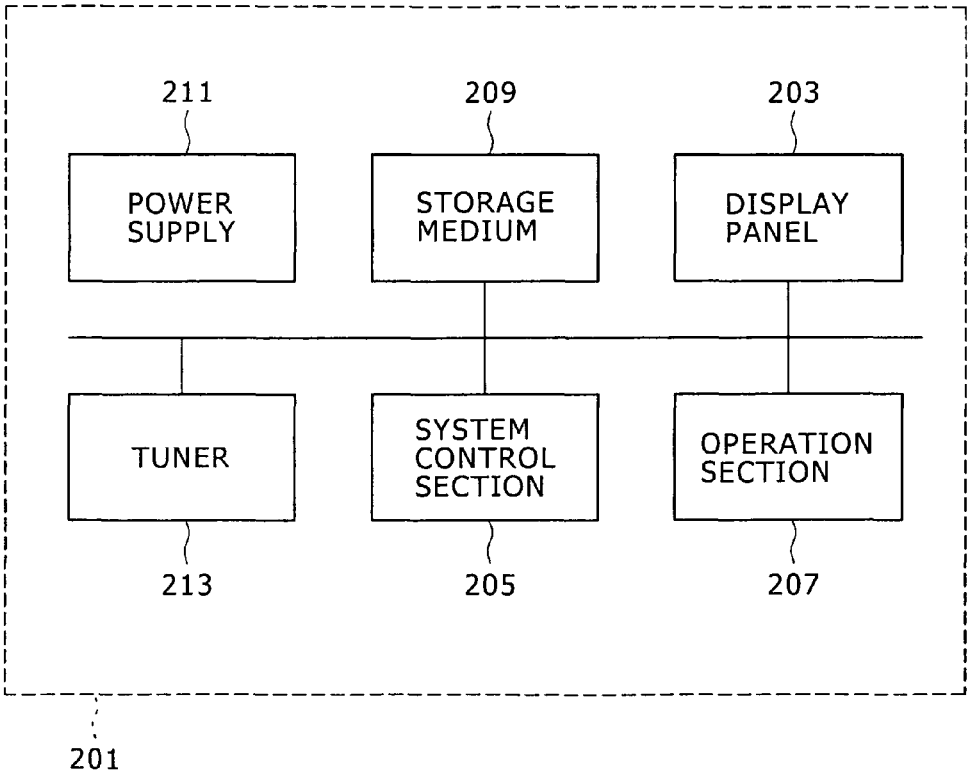
[FIG. 30]

FIG. 30 illustrates an example of functional configuration of the broadcast wave receiver. A broadcast wave receiver 201 includes a display panel 203, a system control section 205, an operation section 207, a storage medium 209, a power supply 211 and a tuner 213 as its main devices.

It should be noted that the system control section 205 includes, for example, a microprocessor. The same section 205 controls the entire operation of the system. The operation section 207 includes not only mechanical controls but also a graphical user interface.

The storage medium 209 is used as a storage area adapted to store not only image and video data to be displayed on the display panel 203 but also firmware and application programs. Battery power is used as the power supply 211 if the broadcast wave receiver 201 is portable. Naturally, commercial power is used if the broadcast wave receiver 201 is stationary.

The tuner 213 is a wireless-device operable to selectively receive the broadcast wave of the user-selected specific channel from among incoming broadcast waves.

The configuration of this broadcast wave receiver is applicable, for example, to television and radio program receivers.

(c2) Audio Device

Figure 31:
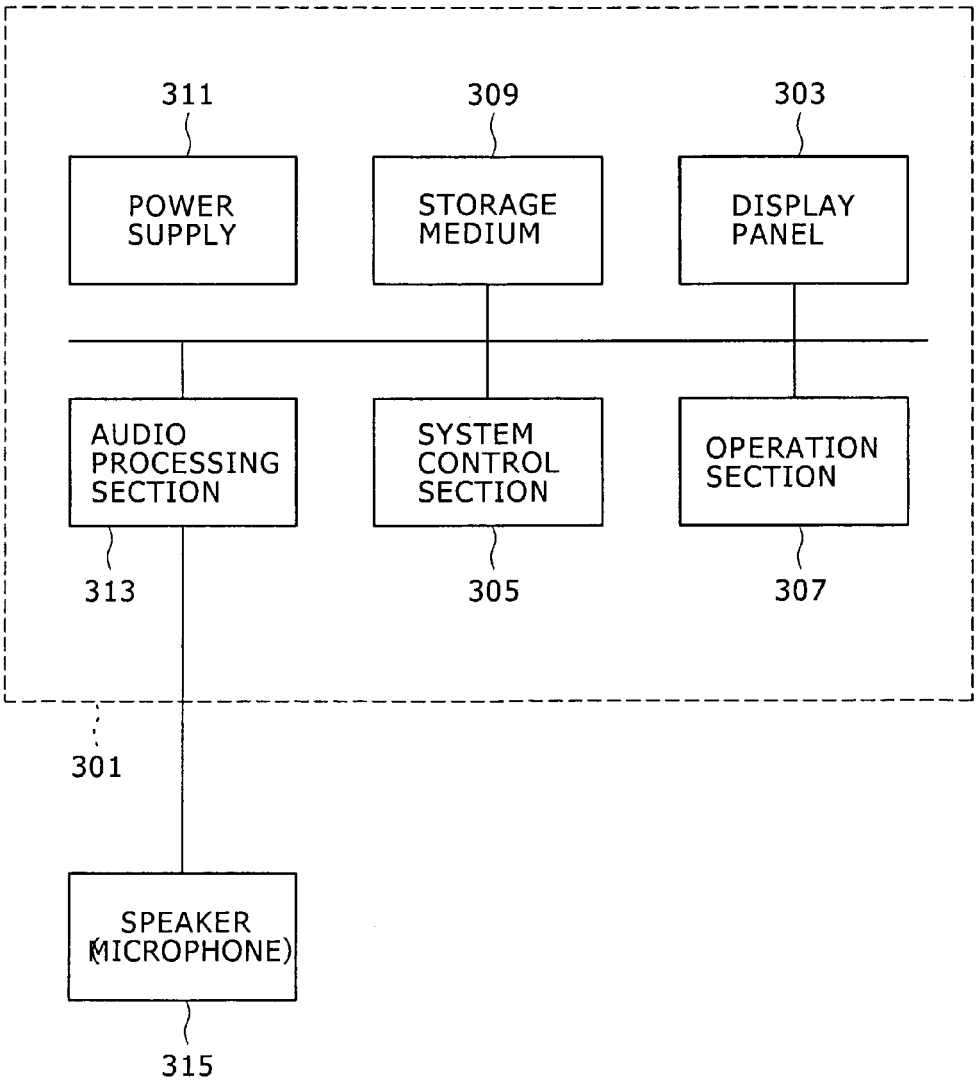
[FIG. 31]

FIG. 31 illustrates an example of functional configuration of an audio device serving as an audio player to which the aforementioned power consumption and peak brightness controllers are applied.

An audio device 301 serving as an audio player includes a display panel 303, a system control section 305, an operation section 307, a storage medium 309, a power supply 311, an audio processing section 313 and a speaker 315 as its main devices.

Also in this case, the system control section 305 includes, for example, a microprocessor. The same section 305 controls the entire operation of the system. The operation section 307 includes not only mechanical controls but also a graphical user interface.

The storage medium 309 is a storage area adapted to store not only audio data but also firmware and application programs. Battery power is used as the power supply 311 if the audio device 301 is portable. Naturally, commercial power is used if the audio device 301 is stationary.

The audio processing section 313 is a processing device operable to process audio data signals. The same section 313 also decompresses compression-coded audio data. The speaker 315 outputs reproduced sounds.

It should be noted that if the audio device 301 is used as an audio recorder, a microphone is connected in place of the speaker 315. In this case, the audio device 301 provides the capability to compression-code audio data.

(c3) Communication Device

Figure 32:
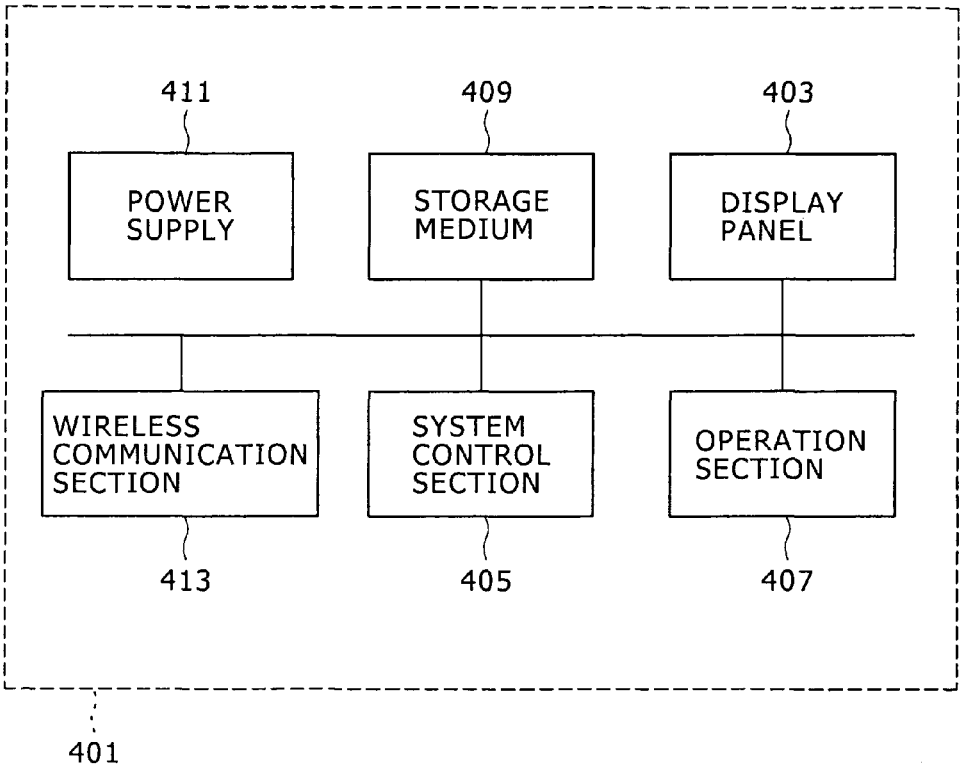
[FIG. 32]

FIG. 32 illustrates an example of functional configuration of a communication device to which the aforementioned power consumption and peak brightness controllers are applied. A communication device 401 includes a display panel 403, a system control section 405, an operation section 407, a storage medium 409, a power supply 411 and a wireless communication section 413 as its main devices.

It should be noted that the system control section 405 includes, for example, a microprocessor. The same section 405 controls the entire operation of the system. The operation section 407 includes not only mechanical controls but also a graphical user interface.

The storage medium 409 is used as a storage area adapted to store not only image and video data files to be displayed on the display panel 403 but also firmware and application programs. Battery power is used as the power supply 411 if the communication device 401 is portable. Naturally, commercial power is used if the communication device 401 is stationary.

The wireless communication section 413 is a wireless device operable to exchange data with other devices. The configuration of this communication device is applicable, for example, to a stationary telephone set and mobile phone.

(c4) Imaging Device

Figure 33:
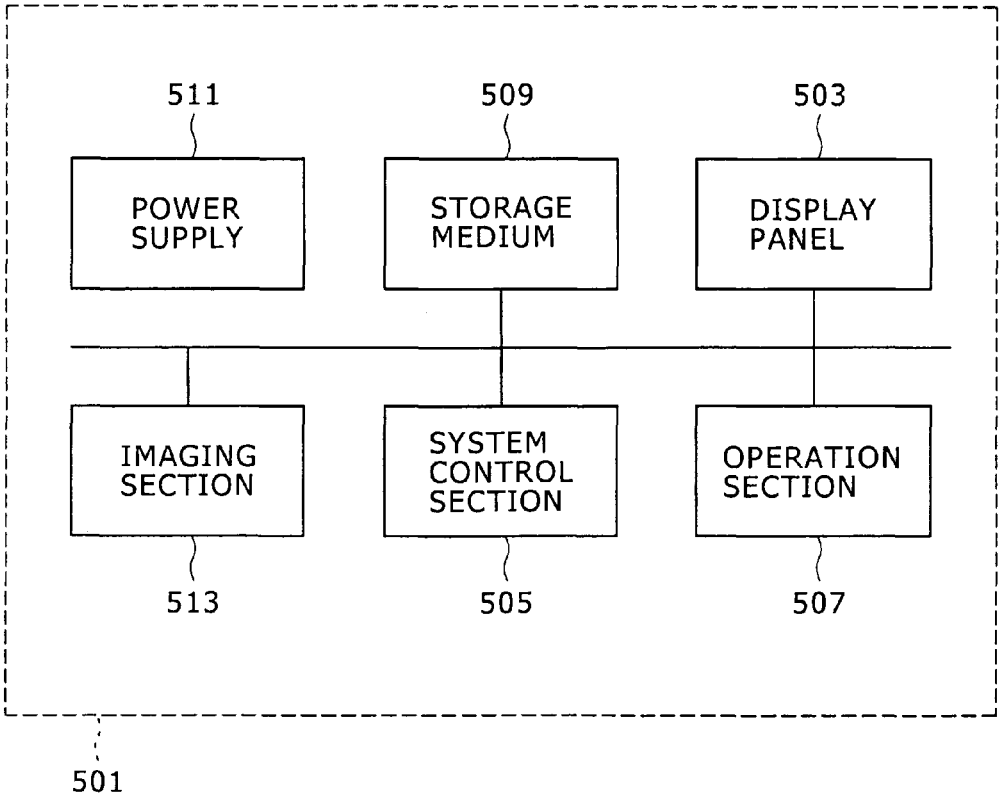
[FIG. 33]

FIG. 33 illustrates an example of functional configuration of an imaging device to which the aforementioned power consumption and peak brightness controllers are applied. An imaging device 501 includes a display panel 503, a system control section 505, an operation section 507, a storage medium 509, a power supply 511 and an imaging section 513 as its main devices.

It should be noted that the system control section 505 includes, for example, a microprocessor. The same section 505 controls the entire operation of the system. The operation section 507 includes not only mechanical controls but also a graphical user interface.

The storage medium 509 is used as a storage area adapted to store not only image and video data files to be displayed on the display panel 503 but also firmware and application programs. Battery power is used as the power supply 511 if the imaging device 501 is portable. Naturally, commercial power is used if the imaging device 501 is stationary.

The imaging section 513 includes, for example, a CMOS sensor and a signal processing section operable to process the output signal from the CMOS sensor. The configuration of this imaging device is applicable, for example, to a digital camera and video camcorder.

(c5) Information Processing Device

Figure 34:
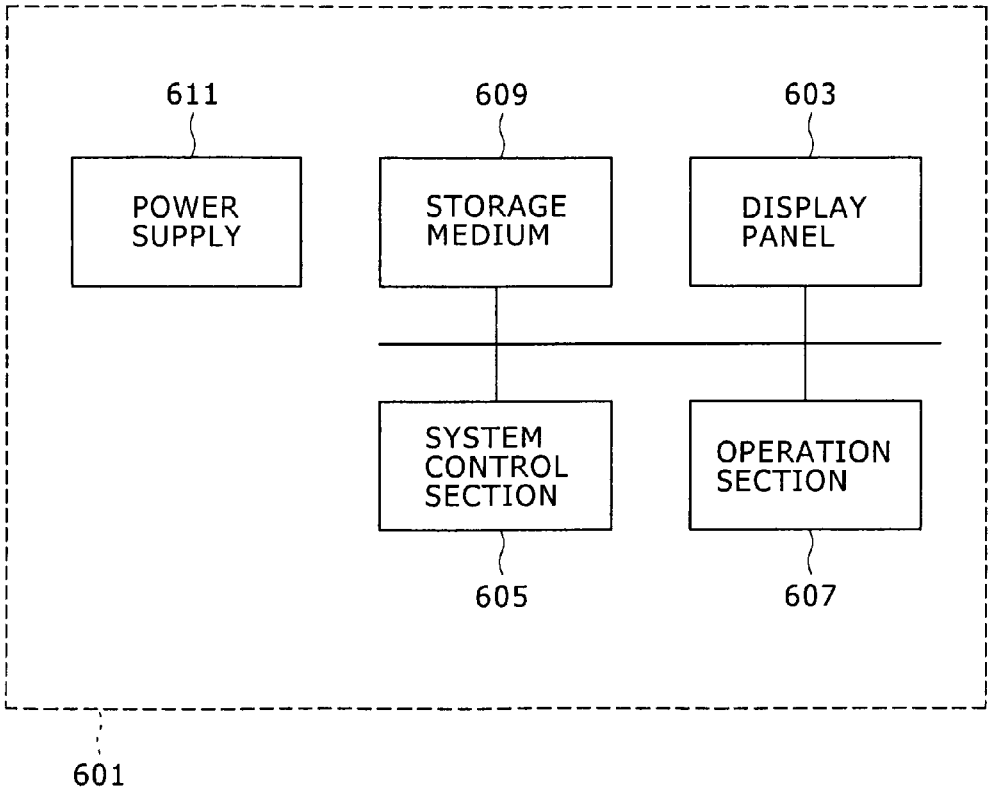
[FIG. 34]

FIG. 34 illustrates an example of functional configuration of a portable information processing device to which the aforementioned power consumption and peak brightness controllers are applied. An information processing device 601 includes a display panel 603, a system control section 605, an operation section 607, a storage medium 609 and a power supply 611 as its main devices.

It should be noted that the system control section 605 includes, for example, a microprocessor. The same section 605 controls the entire operation of the system. The operation section 607 includes not only mechanical controls but also a graphical user interface.

The storage medium 609 is used as a storage area adapted to store not only image and video data files to be displayed on the display panel 603 but also firmware and application programs. Battery power is used as the power supply 611 if the information processing device 601 is portable. Naturally, commercial power is used if the information processing device 601 is stationary.

The configuration of this information processing device is applicable, for example, to a gaming machine, electronic book, electronic dictionary and computer.

(D-2) Display Apparatus

The foregoing embodiments were described by taking an organic EL display panel as an example. However, this display control technique is widely applicable to other types of self-luminous display apparatus. For example, the technique is applicable to display panels such as inorganic EL display panel and FED display panel.

(D-3) Computer Program

The power consumption and peak brightness controllers described in the foregoing embodiments can be implemented by hardware or software alone or the two in combination with each other, with each assigned to perform specific functions.

(D-4) Peak Brightness Control Timing

In the above description, the case was described where the peak brightness was controlled upon detection of the power consumption level in excess of half the allowable limit or the allowable limit on a pixel by pixel basis.

Figures 35A, 35B:
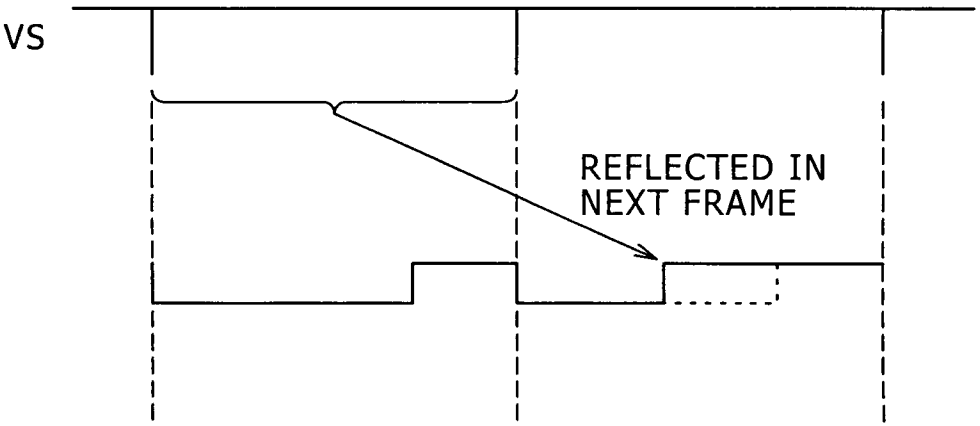
FIGS. 35(A) and 35(B) are views describing the relationship between when a peak brightness control condition occurs and when peak brightness control is performed.

However, the peak brightness may be controlled in the next frame as illustrated in FIG. 35. It should be noted that the peak brightness control condition is determined on a pixel by pixel or horizontal line by horizontal line basis. FIGS. 35(A) and 35(B) illustrate the case where the duty pulse length is reduced to less than the set length. FIG. 35(A) illustrates the input timing of the vertical synchronizing pulse. FIG. 35(B) illustrates the waveform of the duty pulse output for control purposes. Naturally, this peak brightness control is applicable to supply voltage control.

Further, the peak brightness may be controlled in synchronism with the horizontal line timing. Also in this case, the peak brightness control condition is determined on a pixel by pixel or horizontal line by horizontal line basis. Incidentally, FIGS. 36(A) to 36(D) also illustrate the case where the duty pulse length is reduced to less than the set length. If the video signal is a still image, controlling the peak brightness in the next frame as described above eliminates any difference in brightness over the screen.

Figures 36A, 36B, 36C, 36D:
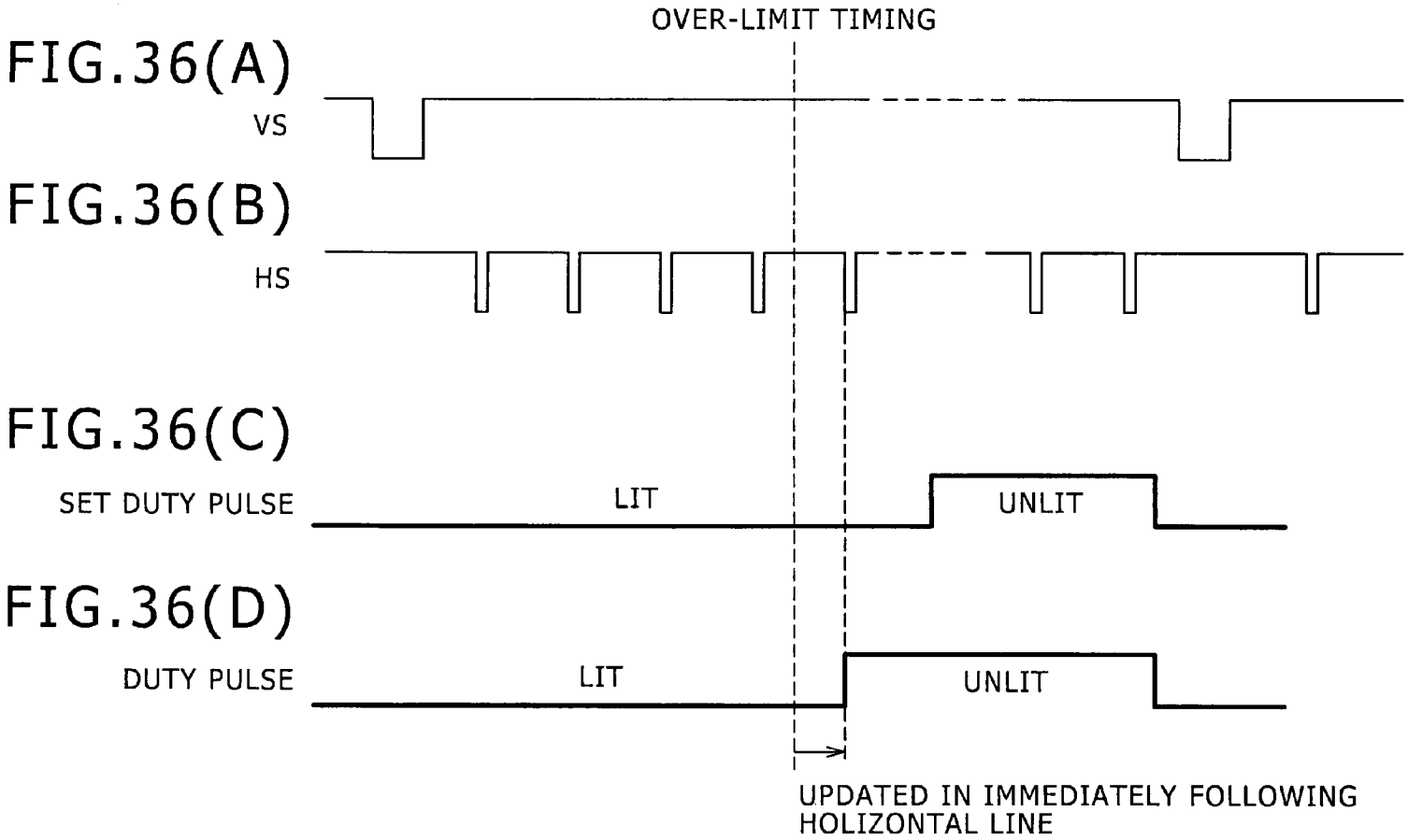
FIGS. 36(A) to 36(D) are views describing another relationship between when a peak brightness control condition occurs and when peak brightness control is performed.

FIG. 36(A) illustrates the input timing of the vertical synchronizing pulse. FIG. 36(B) illustrates the input timing of the horizontal synchronizing pulse. FIG. 36(C) illustrates an example of the set duty pulse. FIG. 36(D) illustrates the duty pulse output for control purposes.

As illustrated in FIGS. 36(B) and 36(D), an over-limit timing occurs in the middle of a horizontal line period. However, the duty pulse length is reduced at the immediately following horizontal line timing. As described above, controlling the peak brightness on a pixel by pixel or horizontal line by horizontal line basis effectively keeps down power consumption, for example, if the video signal is a moving image.

(D-5) Duty Pulse

Figures 37A, 37B:
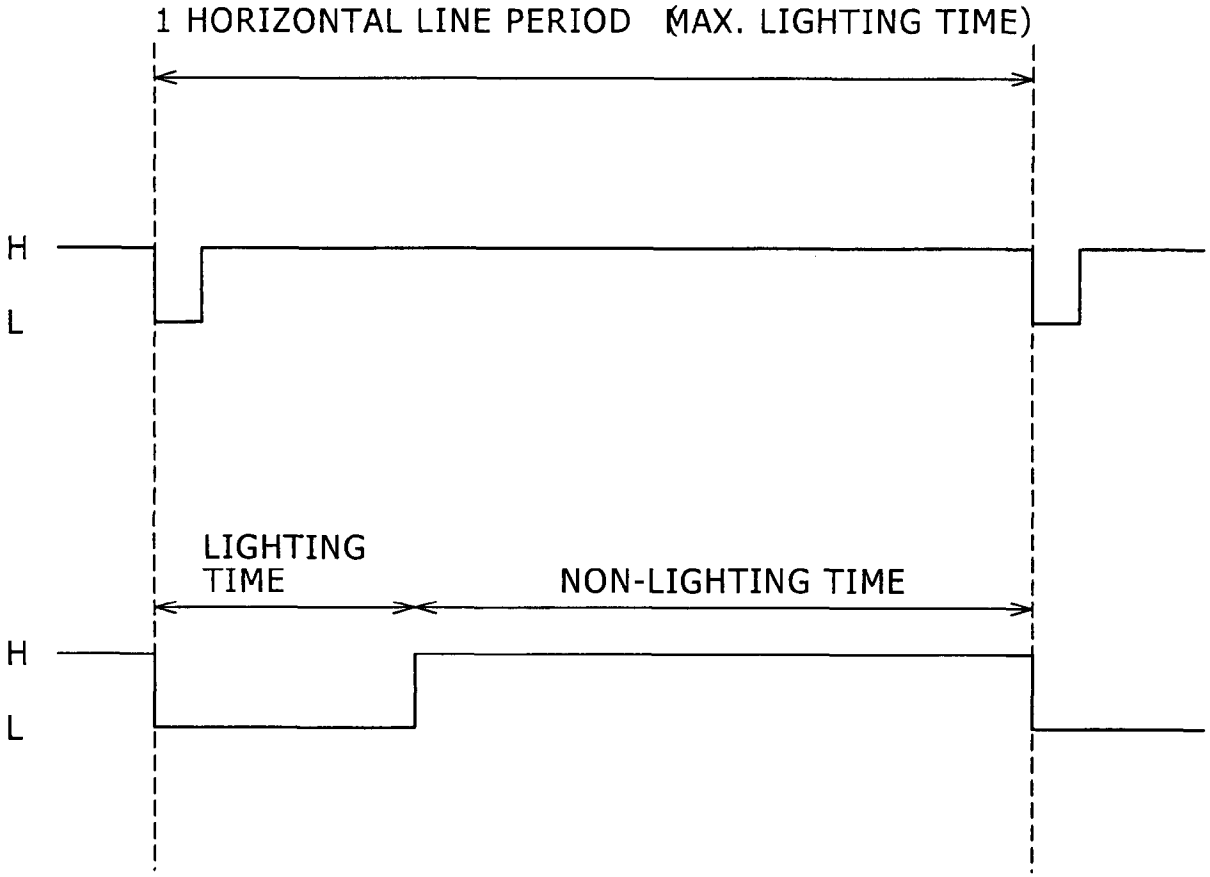
FIGS. 37(A) and 37(B) are views describing another example of using a duty pulse.

In the above description, the duty pulse was described as a signal adapted to control the lighting and non-lighting times per frame period. As illustrated in FIGS. 37(A) and 37(B), however, the duty pulse (FIG. 37(B)) may be defined as a signal adapted to control the lighting and non-lighting times per horizontal line period (FIG. 37(A)). This means that, of as many duty pulses generated per frame period as the vertical resolution, the length of a duty pulse generated at a given timing onward is varied.

Also in the above description, the case was described where the duty pulse was at high and low levels once each per frame period.

Figures 38A, 38B:
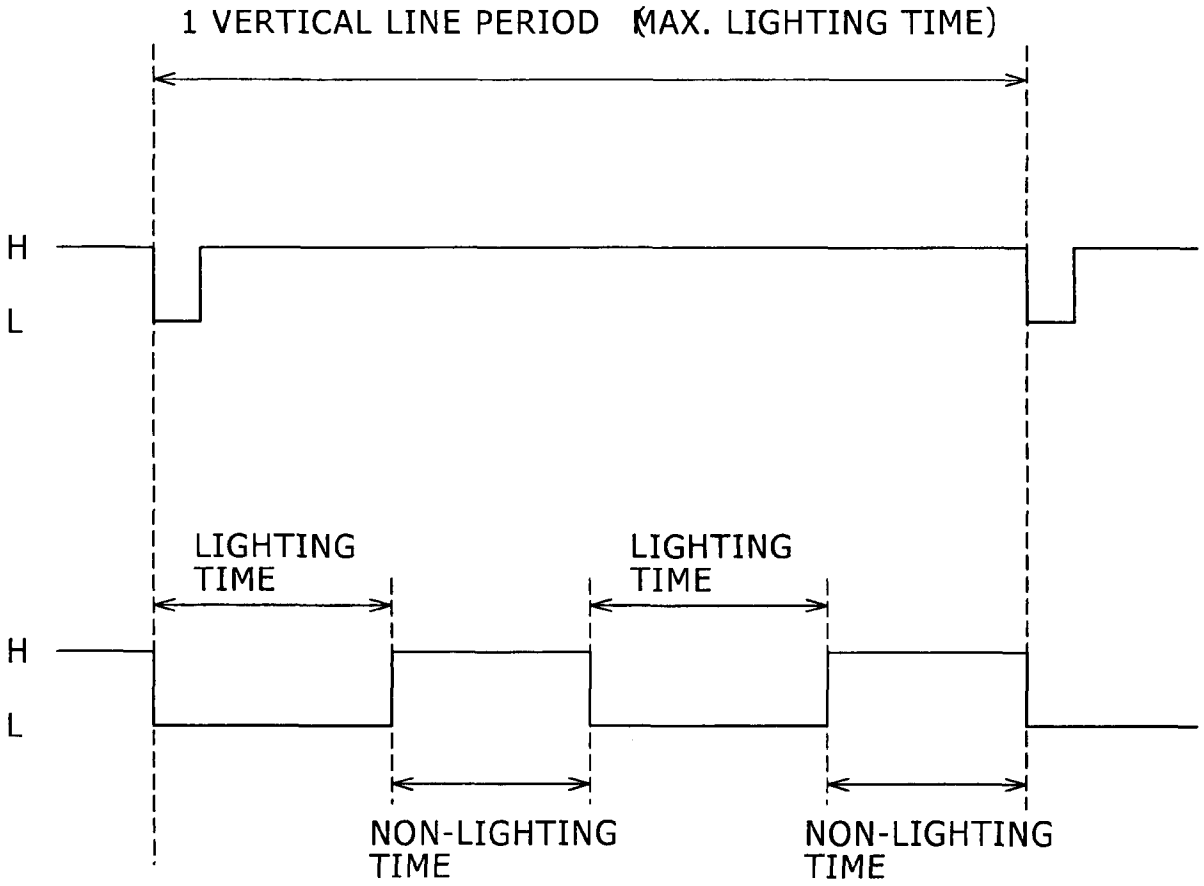
FIGS. 38(A) and 38(B) are views describing still another example of using a duty pulse.

As illustrated in FIG. 38(B), however, the aforementioned control techniques are applicable when the duty pulse is at high and low levels a plurality of times each per frame period (FIG. 38(A)).

(D-6) Others

In the above description, the description of a concrete example was omitted in which the control technique 2 was combined with the continuous control of the duty pulse. However, if the current flowing through the emission period control element T3 can be varied according to the amplitude of the duty pulse, the brightness can be continuously reduced by continuously varying the current flow through the same element T3.

In addition to the above, various other modifications are possible without departing from the scope of the invention. Further, various modifications and application examples created or combined based on the description herein are also possible.

The invention claimed is:

1. A power consumption controller comprising:

a power consumption calculation section operable to sequentially calculate power consumption levels of a plurality of frames of a video signal displayed by a self-luminous display device from a beginning of each of the plurality of frames up to a time of calculation;

a power consumption status determination section operable to continuously determine whether a respective power consumption level exceeds a reference value within a given frame, to detect a timing at which the power consumption exceeds the reference value within the given frame if the power consumption level exceeds the reference value for the given frame, and to output an over-limit timing signal at the detected timing at which the respective power consumption level exceeds the reference value; and a peak brightness control section operable to control a peak brightness of the self-luminous display device based on the over-limit timing signal.

2. The power consumption controller of claim 1, wherein the peak brightness control section controls the peak brightness of the self-luminous display device on a pixel by pixel basis.

3. The power consumption controller of claim 1, wherein the peak brightness control section controls the peak brightness of the self-luminous display device on a horizontal line by horizontal line basis.

4. The power consumption controller of claim 1, wherein the peak brightness control section controls the peak brightness of the self-luminous display device on a per-frame basis.

5. The power consumption controller of claim 1, wherein the peak brightness control section changes a duty pulse length, which gives an actual length of lighting time per frame period as a peak brightness condition of the self-luminous display device, so that the earlier the detection of the timing at which the power consumption level exceeds the reference value occurs, the shorter the duty pulse length.

6. The power consumption controller of claim 1, wherein the peak brightness control section changes a supply voltage level applied to a self-luminous element as a peak brightness condition of the self-luminous display device.

7. The power consumption controller of claim 1, wherein the video signal is a sequential input that is received by the power consumption calculation section, wherein the power consumption calculation section is configured to convert the sequential input into a pixel currents, wherein the power consumption calculation section is configured to cumulatively add up the pixel currents for each pixel to calculate the total current, and wherein the power consumption calculation section is configured to multiply the total current by a supply voltage to calculate the power consumption of the video signal from the beginning of each of the plurality of frames up to the time of calculation.

8. The power consumption controller of claim 1, wherein the power consumption calculation section is configured to transmit the power consumption to the power consumption status determination section each time the power consumption is updated.

9. The power consumption controller of claim 1, wherein the power consumption status determination section is configured to determine whether the calculated power consumption level exceeds each of two reference values for comparison by constantly comparing the power consumption level against each of the two reference values.

10. The power consumption controller of claim 1, wherein the power consumption calculation section is configured to calculate a sum of a current for the video signal from the beginning of each of the plurality of frames up to the time of calculation, and calculate the power consumption level of each framed by multiplying the sum of the current by a supply voltage.

11. The power consumption controller of claim 10, wherein the sum of the current is updated for each frame a pixel by pixel basis or every horizontal line period by accumulating a current for a horizontal resolution.

12. The power consumption controller of claim 10, wherein the supply voltage at a time of the power consumption level calculation is used when the supply voltage is varied to control the peak brightness.

13. An image processor comprising:

a power consumption calculation section operable to sequentially calculate power consumption levels of a plurality of frames of a video signal displayed by a self-luminous display device having self-luminous elements and pixel circuits thereof arranged in a matrix form from a beginning of each of the plurality of frames up to a time of calculation;

a power consumption status determination section operable to continuously determine whether a respective power consumption level exceeds a reference value within a given frame, to detect a timing at which the power consumption exceeds the reference value within the given frame if the power consumption level exceeds the reference value for the given frame, and to output an over-limit timing signal at the detected timing at which the respective power consumption level exceeds the reference value; and a peak brightness control section operable to control a peak brightness of the self-luminous display device based on the over-limit timing signal.

14. A self-luminous display apparatus comprising:

a self-luminous display device having self-luminous elements and pixel circuits thereof arranged in a matrix form;

a power consumption calculation section operable to sequentially calculate power consumption levels of a plurality of frames of a video signal displayed by a self-luminous display device from a beginning of each of the plurality of frames up to a time of calculation;

a power consumption status determination section operable to continuously determine whether a respective power consumption level exceeds a reference value within a given frame, to detect a timing at which the power consumption exceeds the reference value within the given frame if the power consumption level exceeds the reference value for the given frame, and to output an over-limit timing signal at the detected timing at which the respective power consumption level exceeds the reference value; and a peak brightness control section operable to control a peak brightness of the self-luminous display device based on the over-limit timing signal.

15. Electronic equipment comprising:

a self-luminous display device having self-luminous elements and pixel circuits thereof arranged in a matrix form;

a power consumption calculation section operable to sequentially calculate power consumption levels of a plurality of frames of a video signal displayed by a self-luminous display device from a beginning of each of the plurality of frames up to a time of calculation;

a power consumption status determination section operable to continuously determine whether a respective power consumption level exceeds a reference value within a given frame, to detect a timing at which the power consumption exceeds the reference value within the given frame if the power consumption level exceeds the reference value for the given frame, and to output an over-limit timing signal at the detected timing at which the respective power consumption level exceeds the reference value; and a peak brightness control section operable to control a peak brightness of the self-luminous display device based on the over-limit timing signal.

16. A power consumption control method comprising:

sequentially calculating power consumption levels of a plurality of frames of a video signal displayed by a self-luminous display device from a beginning of each of the plurality of frames up to a time of calculation;

continuously determining whether a respective power consumption level exceeds a reference value within a given frame, detecting a timing at which the power consumption exceeds the reference value within the given frame if the power consumption level exceeds the reference value for the given frame, and outputting an over-limit timing signal at the detected timing at which the respective power consumption level exceeds the reference value; and controlling a peak brightness of the self-luminous display device based on the over-limit timing signal.

17. A non-transitory computer readable medium storing program code, that when executed by a processing unit causes the processing unit to perform:

sequentially calculating power consumption levels of a plurality of frames of a video signal displayed by a self-luminous display device from a beginning of each of the plurality of frames up to a time of calculation;

continuously determining whether a respective power consumption level exceeds a reference value within a given frame, detecting a timing at which the power consumption exceeds the reference value within the given frame if the power consumption level exceeds the reference value for the given frame, and outputting an over-limit timing signal at the detected timing at which the respective power consumption level exceeds the reference value; and controlling a peak brightness of the self-luminous display device if the power consumption level exceeds the reference value for comparison based on the over-limit timing signal.

18. A method for controlling power consumption of a self-luminous display device, the method comprising:

calculating a cumulative power consumption level during a frame period of a video signal of the self-luminous display device;

determining a timing at which the cumulative power consumption exceeds a reference value during the frame period within a given frame if the power consumption level exceeds the reference value for the given frame, and outputting an over-limit timing signal at the detected timing at which the cumulative power consumption level exceeds the reference value; and adjusting a peak brightness of the self-luminous display device for a remainder of the frame period, said adjusting depending upon the over-limit timing signal.

* * * * *